US012473675B2

(12) United States Patent
Mooshammer et al.

(10) Patent No.: US 12,473,675 B2
(45) Date of Patent: Nov. 18, 2025

(54) SUCTION NOZZLE, JET SUCTION BOX AND JET SUCTION METHOD

(71) Applicant: Autefa Solutions Germany GmbH, Friedberg (DE)

(72) Inventors: Anton Mooshammer, Aschersleben (DE); Michael Hartmann, Augsburg (DE); Christian Richter, Berlin (DE)

(73) Assignee: Autefa Solutions Germany GmbH, Friedberg (DE)

( * ) Notice: Subject to any disclaimer, the term of this patent is extended or adjusted under 35 U.S.C. 154(b) by 21 days.

(21) Appl. No.: 18/342,835

(22) Filed: Jun. 28, 2023

(65) Prior Publication Data

US 2024/0003066 A1 Jan. 4, 2024

(30) Foreign Application Priority Data

Jun. 29, 2022 (DE) ..... 20 2022 103 600.4

(51) Int. Cl.
*D04H 18/04* (2012.01)
*D06B 15/04* (2006.01)

(52) U.S. Cl.
CPC ..... *D04H 18/04* (2013.01); *D06B 15/04* (2013.01)

(58) Field of Classification Search
CPC .. D06B 15/04; D06B 15/043; D06B 19/0041; D06B 19/0058; D04H 18/04; D06C 29/005
USPC .... 28/104, 105; 15/304, 307, 322, 354, 357, 15/359, 360
See application file for complete search history.

(56) References Cited

U.S. PATENT DOCUMENTS

| | | | | |
|---|---|---|---|---|
| 2,142,711 A | | 1/1939 | Birch | |
| 2,825,925 A | * | 3/1958 | Acheson | A47L 9/0416 15/354 |
| 3,493,462 A | * | 2/1970 | Bunting, Jr. | D04H 1/492 162/204 |
| 3,992,746 A | * | 11/1976 | Rhodes | D06B 15/043 15/307 |
| 4,197,609 A | | 4/1980 | Führing | |

FOREIGN PATENT DOCUMENTS

| | | |
|---|---|---|
| AT | 178084 B | 4/1954 |
| CN | 103459713 A | 12/2013 |
| CN | 113166998 A | 7/2021 |
| DE | 102008041127 A1 | 2/2010 |

(Continued)

*Primary Examiner* — Clinton T Ostrup
(74) *Attorney, Agent, or Firm* — McGlew and Tuttle, P.C.

(57) ABSTRACT

A suction nozzle (23) for a hollow jet suction box (14) is used for sucking liquid jets (4). The jet suction box has on a box casing (18) at least one slot casing opening (20) to a box interior space (17). The suction nozzle (23, 23") has a nozzle body (24), arrangeable above the casing opening (20), with a slot suction opening (25), which passes through the nozzle body in a flow direction (23'). The suction opening extends from an inlet side (26) at a free end to an outlet side (27), arrangeable at the casing opening. The nozzle body has a mobile sealing element (29, 29') adjacent the suction opening and laterally defining the slot-like suction opening and a resilient expansion device (33), which acts on the sealing element (29, 29') and pushes the sealing element outward, away from the outlet side, against the suction flow direction.

19 Claims, 19 Drawing Sheets

(56) References Cited

FOREIGN PATENT DOCUMENTS

| | | | |
|---|---|---|---|
| DE | 202018107163 | U1 | 3/2020 |
| EP | 1059377 | A1 | 12/2000 |
| EP | 1783271 | A1 | 5/2007 |
| GB | 813641 | A | 5/1959 |
| JP | 2002327367 | A | 11/2002 |
| WO | 2005059217 | A1 | 6/2005 |
| WO | 2020120412 | A1 | 6/2020 |

* cited by examiner 4
11,12
29'
25
34
29
33,33'
22
31
31'
23,23",24
30
23'
32
28
19
37
20
18
17
20
16
19
43
19
20

SUCTION NOZZLE, JET SUCTION BOX AND JET SUCTION METHOD

CROSS REFERENCE TO RELATED APPLICATIONS

This application claims the benefit of priority under 35 U.S.C. § 119 of German Application DE 20 2022 103 600.4, filed Jun. 29, 2022, the entire contents of which are incorporated herein by reference.

TECHNICAL FIELD

The present invention pertains to a suction nozzle, to a jet suction box for a suction-extraction device of a device for carrying out the hydroentanglement of fibrous material webs and to a jet suction method.

BACKGROUND

Such a suction nozzle with a jet suction box and jet suction method is known from WO 2020/120412 A1.

EP 1 059 377 A1 shows another suction nozzle with a jet suction box and jet suction method.

SUMMARY

It is an object of the present invention to provide improved jet suction technology.

The present invention accomplishes this object with the suction nozzle features, the jet suction box features, the suction-extraction device features, the hydroentanglement device features and the method features according to the invention.

The jet suction technology disclosed herein, i.e., the suction nozzle, the jet suction box equipped therewith and the jet suction method as well as the suction-extraction device and the hydroentanglement device equipped therewith have various advantages.

A first aspect of the present invention provides for a suction nozzle for a hollow jet suction box, which has at least one slot-like (slot shaped or slot) casing opening leading to a box interior space at its box casing, wherein the suction nozzle has a nozzle body, which can be arranged above the casing opening, and a slot-like suction opening, which passes through the nozzle body in a suction flow direction, and which has an upwardly directed inlet side and an outlet side for the suction flow. The suction opening extends from the inlet side at the free end of the nozzle body to the opposite outlet side, which is intended and configured for arrangement at the casing opening of the box casing.

The nozzle body has, on the inlet side, at least one mobile, preferably strip-shaped, sealing element arranged next to the suction opening and laterally defining the slot-like suction opening as well as a resilient expansion device, which acts on the sealing element and which is configured to push the sealing element away from the outlet side and from the casing opening and towards the outside against the suction flow direction.

The suction nozzle may be used to suck the water jets emitted from a hydroentanglement device for the liquid jet hydroentanglement, especially water jet hydroentanglement, of a moving fibrous material web, and exiting again from the fibrous material web, in a suction flow. The suction flow direction may coincide with the emission direction of the liquid jets, especially water jets.

Another aspect of the present invention provides for a jet suction box for a suction-extraction device of a hydroentanglement device for the liquid jet hydroentanglement, especially water jet hydroentanglement, of a moving fibrous material web, especially of a nonwoven, which sucks the liquid jets emitted from the hydroentanglement device and is again discharged from the fibrous material web in a suction flow. The hollow jet suction box has on its box casing at least one slot-like casing opening leading to its box interior space, wherein at least one suction nozzle with a nozzle body arranged above the casing opening and with a slot-like suction opening passing through the nozzle body in a suction flow direction, is arranged at the box casing, wherein the inlet side of said suction opening is directed outwards and the outlet side of said suction opening is directed towards the casing opening. The suction nozzle is configured in the manner being claimed.

The liquid jets emitted from the hydroentanglement device and leaving the fibrous material web can be sucked by the one or more suction nozzles that can be positioned or are positioned correspondingly at the jet suction box. One or more suction nozzles at the jet suction box can also be used with their suction flow for the additional dehumidification of the fibrous material web without sucking liquid jets.

The at least one mobile sealing element may be arranged movably and possibly guided in and against the suction flow direction. The mobile arrangement and possible guiding may be translatory and/or rotatory. The at least one sealing element may, in addition, be arranged movably at right angles to the suction flow direction and adjustably, e.g., for adjusting the nozzle width. The resilient expansion device can act on the associated sealing element and can move and drive this against the suction flow direction. The configuration and the kinematics of the mobile sealing element and of the resilient expansion device may vary.

Another aspect of the present invention pertains to a method for sucking such emitted liquid jets.

The suction nozzle with its configuration being claimed and function may be an independent component, which can be attached to existing jet suction boxes, e.g., by way of a retrofitting or conversion. These do not have to be configured and arranged in the manner being claimed. For example, older jet suction boxes of different configurations can thus be modernized. Retrofitting or conversion is possible, for example, on a jet suction box according to the prior-art references mentioned in the introduction.

The jet suction box being claimed may be an independent component of a suction-extraction device and possibly of a hydroentanglement device, especially water jet hydroentanglement device, equipped therewith. The jet suction box can be retrofitted or converted on existing suction-extraction devices. It may also be implemented as original equipment in a new suction-extraction device. The jet suction box and the suction-extraction device may further be a part of a liquid jet hydroentanglement device, especially for the water jet hydroentanglement of a moving fibrous material web, especially of a non-woven.

The jet suction technology being claimed offers increased efficiency, economy and sustainability as well as a higher flexibility. Thanks to the one or more mobile sealing elements and to the resilient expansion device thereof at the respective suction nozzle, the jet suction technique makes possible a better sealability of the jet suction box against a conveying device of the moving material web. Any possible balance errors, assembly tolerances and structural shape tolerances of the conveying device and of the jet suction box can be compensated. The entry of infiltrated air into the suction opening, especially the admission from an interior space of a drum-like conveying device, can be avoided with a high level of certainty.

This also leads to better and more constant hydroentanglement results during the hydroentanglement of a fibrous material web with high-pressure liquid jets, especially high-pressure water jets. The air/liquid mixture sucked out has a higher percentage of liquid. It can be regenerated better and more efficiently, especially for recycling and reuse of the liquid at the hydroentanglement device. Further, advantages arise for an efficient dehumidification of the fibrous material web.

The pressure loss at the jet suction box can be maintained at an especially low level, which makes possible the use of a weaker suction and pumping technique and improves the precision of control. The amount of energy needed and the design effort can be markedly reduced. This improves the process quality, efficiency and economy and reduces the use of resources. The noise emission can be significantly abated. The favorable effects of the jet suction technology being claimed increase with increasing velocity of flow at the nozzle outlet and with increasing velocity of the removal of the air/liquid mixture from the hollow box interior space.

In one embodiment, the suction nozzle may have a mobile sealing element on one side of the preferably slot-like suction opening and a stationary nozzle body wall on the other side of the suction opening. In another preferred embodiment, the suction nozzle may have a plurality of, especially two of the mobile sealing elements with the respective one or more resilient expansion devices, which are arranged on both sides of the preferably slot-like suction opening. The mobile sealing element or the mobile sealing elements is/are arranged at the free end of the nozzle body. They may form the free end of the body.

The mobile sealing element or the mobile sealing elements may extend along the suction opening in a direction at right angles to the suction flow direction. The mobile sealing element or the mobile sealing elements may also extend, in at least some areas, along the suction flow direction.

The mobile sealing elements arranged on both sides of the slot-like suction opening have each a side wall, which is directed towards the suction opening and laterally limits the suction opening, the sealing elements arranged on both sides defining between them the suction opening on the inlet side.

A strip-shaped configuration of the one or more sealing elements is favorable. These preferably extend over the entire length of the suction opening. The strip-shaped configuration may be continuously in one piece axially or segmented.

The at least one, preferably strip-shaped sealing element may have different configurations and may be guided in different manners. The nozzle body may have a guide device for the at least one mobile sealing element. The guide device may comprise correspondingly configured and arranged guide units for the guiding tasks. The guide units may be formed, e.g., by guide rods along with guide openings, e.g., elongated holes, and/or by one or more leaf springs.

Said sealing element may have, e.g., a loose configuration and be independently movable. It may be guided in this case movably by a guide device with a preferably rigid guide unit, e.g., guide rods along with guide openings, in the suction flow direction and against the suction flow direction. The motion of the sealing device may be translatory and/or rotatory. The rigid guide unit may extend along the suction flow direction. The motion of the sealing device may be especially a linear displacement motion. The resilient expansion device may act, e.g., directly on said sealing element.

In another embodiment, said sealing element may be mounted at a mobile, especially deformable guide unit of a guide device. The mobile guide unit may extend mainly at right angles to the suction flow direction. The guide unit, configured, e.g., as a leaf spring, can move said sealing element movably in and against the suction flow direction in a suitable manner, e.g., in a rotatory manner, especially with a pivoting motion. The resilient expansion device may act on the guide unit and can act as a result directly on said sealing element.

The one or more sealing elements are intended and configured to be sealingly in contact by their outer side with said conveying device, especially with a rotating conveying drum, and to be pressed resiliently by the expansion device. The one or more sealing elements may have a configuration favorable in terms of friction at least in this contact area. They may have a correspondingly adapted, e.g., rounded or beveled outer geometry and/or be formed from a low-friction material.

The resilient expansion device, which may be a single expansion device or comprise a plurality of expansion devices, may have different configurations. It may comprise, e.g., one or more compression springs, especially compression coil springs. These can be tensioned during the assembly of the jet suction box at or in the conveying device. Such compression springs may be configured as mechanical springs, as compressible solids, as compressible fluids, e.g., gas blankets, pneumatic springs, etc., or in another form.

The resilient expansion device may also be configured as a switchable expansion device and/or as an expansion device expandable in a controlled manner. The resilient expansion device may be operated to this end, e.g., with a switchable or controllable, possibly also regulatable, preferably compressible pressurized medium, e.g., pressurized gas. The resilient expansion device may have now, e.g., an expander operated with the compressible pressurized medium, which expander is stretched by said pressurized medium. The expander may comprise, e.g., a gas-operated pressure ram and/or an inflatable flexible pressure tubing, a pressure bellows or the like.

The switchable and/or controllable configuration of the resilient expansion device has the advantage of improved possibilities of adaptation to the conditions of use at a conveying device, especially in a rotating conveying drum. On the other hand, the resilient expansion device may also be switched off or its effect can be reduced such that the sealing element or sealing elements, to which pressure is admitted, is/are no longer in contact with spring force with the conveying device. This is favorable for the possibility of mounting the jet suction box and/or the one or more suction nozzles and of removing same with a low resistance. On the other hand, a targeted adaptation of the force of expansion or spring force to variable suction pressures and especially to high suction pressures of, e.g., 250 mbar may be carried out as well.

The jet suction technology being claimed also makes it possible to change and to set the width of the preferably slot-like suction opening. The opening width can be optimally adapted hereby to the particular conditions of use and to different process requirements.

A mobile arrangement of the at least one sealing element at the nozzle body, which is then movable laterally and possibly at right angles to the suction flow direction, is especially favorable. As a result, the setting of the width of the suction opening can be carried out in the area of the at least one sealing element. This area is arranged at the inlet side of the suction opening and at the conveying device. The areas of the suction opening that are directed downstream must not be affected by the adjustment and may have a constant opening width. However, adjustability is possible as an alternative.

It is favorable for the suction method if the width of the suction opening is adjustable above all on the inlet side, and the opening width remains the same on the outlet side and at the casing opening of the box casing. This also offers advantages concerning the accessibility of an adjusting device for the one or more mobile sealing elements. The adjusting device may comprise at least one adjusting unit, which is arranged in the slot-like suction opening and which is accessible from the outside in the slot-like suction opening. The adjusting unit may be configured, e.g., as a variable-length adjusting screw, which can be adjusted with a tool inserted into the suction opening.

The nozzle body may be arranged movably, especially in a displaceable manner, at the box casing by means of a bracket. As a result, the nozzle body can be removed from the overlap with the casing opening in at least some areas. The mobility may be given especially axially and along the principal axis of the jet suction box. A switchable and/or controllable configuration of the resilient expansion device is advantageous for reducing frictional resistances.

The bracket may have a slot-like configuration and be oriented along the suction opening and possibly the casing opening. The nozzle body can as a result be displaced, e.g., by means of a grip in the bracket and pulled off from the box casing. The nozzle body can as a result also be removed from the overlap with the conveying device and, in particular, it can be pulled out of the conveying drum. The nozzle body and the adjusting device are freely accessible hereby and can, in particular, be operated easily and accurately. On the other hand, the nozzle body can be arranged precisely in the predefined operating position at the box casing by means of the bracket. A switchable and/or controllable, resilient expansion device is advantageous for said adjustment of the opening width.

The nozzle body may have an opening edge limiter, which is preferably adjustable, at one or both front ends of the preferably slot-like suction opening and at the at least one mobile sealing element. As a result, the effective opening length of the suction opening can be set and changed as needed. This is advantageous, e.g., for the adaptation to different widths of the fibrous material web. In addition, a front-side limitation and sealing of the suction opening can be brought about by the opening edge limiter in the area of the at least one mobile sealing element. It is especially favorable in this case if the opening edge limiter comprises an adjustable slide, which closes the suction opening at the edge and on the front side and which is guided at the at least one mobile sealing element. The opening edge limiter can be moved along during motions of the at least one sealing element along the suction flow direction.

The nozzle body comprises the above-mentioned guide device for the at least one sealing element. This guide device is used to guide said sealing element during the motions thereof along the suction flow direction and possibly at right angles to the suction flow direction.

The guide device may be configured in the above-mentioned manner. It may be configured, e.g., as a rigid rod guide or cage guide with preferably linear guide kinematics.

Another configuration as a resilient swivel guide has special advantages. The guide device can comprise a guide unit, which is configured as a leaf spring clamped at the edge, at the other, opposite edge of which spring the at least one sealing element is mounted preferably captively and fastened. The fastening may be detachable and positive-locking. The preferably controllable or switchable resilient expansion device can act on the leaf spring and deform same by bending. Such a configuration is especially advantageous when strong expansion forces are desired. The resetting with the expansion device released can be carried out by means of the restoring force of the deformed leaf spring. Such an embodiment of the suction nozzle or of the nozzle body thereof is also advantageous for retrofitting conventional suction boxes.

There are different possibilities for the structural configuration of the nozzle body. The nozzle body may have, e.g., a hollow base part, on which the at least one mobile sealing element is arranged. The hollow base part may have a one-part or multipart configuration. The suction opening passes through it. The resilient expansion device may be arranged between the base part and the at least one mobile sealing element. The guide device may likewise be arranged between the base part and the at least one mobile sealing element.

The base part may space apart the at least one mobile sealing element and the corresponding resilient expansion device in the radial direction or normal direction from the box casing. In this case, it may have different dimensions. This makes possible an adaptation to different insertion specifications of existing jet suction boxes in case of a retrofitting or conversion of the suction nozzle.

In one advantageous embodiment, the hollow base part may comprise a support element, which can be arranged or is arranged above the casing opening, and at least one carrying element, wherein the at least one carrying element is arranged between the support element and the at least one mobile sealing element.

Said carrying element and the associated sealing element may be connected to one another. The at least one mobile sealing element may be arranged movably and guided on or at the associated, at least one carrying element in the suction flow direction. The resilient expansion device can be supported on the at least one carrying element and can act on the associated sealing element directly or indirectly.

The at least one mobile sealing element may be arranged on and above the associated carrying element. It may have a loose configuration and be independently mobile. It may float over the associated carrying element and be carried by the resilient expansion device and be supported in the suction flow direction. The inner sides of the at least one mobile sealing element and of the associated carrying element, which inner sides are directed towards the suction opening, may be flush with one another in the suction flow direction. These inner sides may form in this area the, for example, parallel side walls of a globally funnel-like suction opening.

The outer sides of the at least one mobile sealing element and of the associated carrying element, which outer sides face away from the suction opening, may likewise be flush with one another in the suction flow direction.

In another embodiment, the at least one mobile sealing element may also be arranged in or at the associated carrying element and project over the outer side of said carrying element against the suction flow direction.

The at least one mobile sealing element and the associated, at least one carrying element may be arranged and guided together at right angles to the suction flow direction. As a result, they can be moved and adjusted together, e.g., during an adjustment of the suction opening width. In another variant, e.g., with said leaf spring, the at least one sealing element can be adjusted relative to the support element, especially relative to the carrying element, and at right angles to the suction flow direction.

The support element located between the casing opening and the at least one carrying element may remain in its position and configuration in the different variants and does not need to be moved along. The carrying element may also be omitted. The motion and guiding of the one or more sealing and possibly carrying elements at right angles to the suction flow direction may take place relative to the stationary support element.

The guide device may comprise correspondingly configured and arranged guide elements for the aforementioned guiding tasks. Further, a resilient sealing apron may be arranged on the outer side at the at least one carrying element and at the at least one mobile sealing element. It can cover the gap between these elements.

The support element may have different configurations. In an advantageous embodiment, it has a support cone with sealed cone walls and with a cone bottom permeable to the suction flow. The support cone may be directed with its larger cone opening towards the outlet side of the suction opening or to the casing opening of the box casing. The support element, especially the support cone, may be intended and formed for the contact and possible meshing with the above-mentioned bracket of the nozzle body at the box casing. The meshing may have a fluid-tight configuration.

The nozzle body may have closed side walls and closed front walls. The side walls may be formed by the support element, especially by the support cone. The nozzle body has as a result a sealed configuration all around on the inlet side and on the outlet side aside from the openings of the suction opening. The nozzle body may have on the front side a grip, with which it can be moved at the bracket.

The preferably slot-like suction opening is formed in the nozzle body and it extends in the suction flow direction from the inlet side to the outlet side and to the casing opening located there. The width of the slot-like suction opening can have a cross section increasing from the inlet side to the outlet side. This increase may be continuous or stepwise. The suction opening has a smaller width on the inlet side than on the outlet side. The pressure loss can be kept low on the outlet side due to the increase of the nozzle width in the suction flow direction and also in the jet direction of the liquid jet. The suction opening can have said inverted funnel shape in the cross section.

Thanks to the low pressure loss, a moderate negative pressure in the box interior space and a negative-pressure generator of small dimensions are favorable for achieving the desired negative pressure (vacuum) on the inlet side of the suction nozzle. This is also advantageous for a desired flow velocity of the suction flow at the suction nozzle and at a suction opening of the jet suction box. Such a negative pressure may be, e.g., 15,000 Pa or 150 mbar or higher. The flow velocity may equal, e.g., 25 msec. It is favorable for the jet suction technology being claimed if the suction nozzle and its slot-like suction opening as well as the at least one mobile sealing element are oriented along a suction box axis. They may be oriented at right angles to a motion direction of the fibrous material web. The suction box axis may be the longitudinal axis of the suction box.

In the installed position, the suction nozzle may be located opposite an injector in the emission direction, this injector emitting liquid jets, especially water jets. The suction nozzle and the slot-like suction opening may preferably extend over the entire width of the fibrous material web and possibly also over the entire width of an injector.

The jet suction box may have on its box casing a plurality of suction nozzles arranged in a distributed manner in the circumferential direction. The number and the arrangement of the suction nozzles may be adapted to the number and arrangement of injectors. In addition, one or more additional suction nozzles without association of injectors may be present.

The emitted liquid and the ambient air entrained by the jet from the outside of the fibrous material web can be taken up by the jet suction technology being claimed and especially by the respective suction nozzle especially well and effectively and removed via the jet suction box. The fibrous material web, through which the flow takes place, is hydroentangled thereby especially well, on the one hand, and is moistened as little as possible, on the other hand.

The subsequent drying effort can be lower for the fibrous material web, and the consumption of resources is reduced and the efficiency or economy is increased. The direct and targeted suction of the emitted liquid jets by the one or more suction nozzles is favorable for a possibly bundled guiding of the liquid jets and for avoiding swirling. This may occur, e.g., due to said infiltrated air and could adversely affect the process quality, especially the quality of the hydroentanglement. The at least one sealing element can prevent such swirling due to infiltrated air especially effectively. The liquid jets and the introduced liquid are sucked out to a great extent at the suction nozzles. Additional suction nozzles without associated injectors can additionally suck residual liquid that is possibly present from the fibrous material web.

The jet suction box may have different configurations. In an advantageous embodiment, it is configured as a straight jet suction tube with a cross section that is rotationally symmetrical preferably in at least some areas. The jet suction tube may have a box casing, which has a prismatic shape in at least some areas on the outside and has at least one flattened portion in the area of the at least one casing opening. The nozzle body arranged above the casing opening can extend away from the box casing, especially in the radial direction. A plurality of support struts may be arranged in the slot-like casing opening at the box casing. They may have an advantageous framework-like arrangement. The box casing can be stabilized by the support struts in the area of the casing opening.

The jet suction box may have a preferably axial suction opening. The suction flow can be removed through this suction opening. The jet suction box may be connected to a negative-pressure generator and possibly to a recovery unit. A negative pressure may prevail in the interior space of the jet suction box relative to the surrounding area.

The jet suction box may be combined with a conveying device in different manners. It may be arranged, in particular, within a rotating and perforated conveying drum for a fibrous material web. The arrangement may be relatively stationary relative to the moving conveying device, especially the rotating conveying drum. In another variant, the conveying device may be configured as a conveyor belt or in another manner. The jet suction box may have a bearing surface for the conveying device, especially for the conveying drum.

The suction-extraction device being claimed may comprise the jet suction box being claimed. It may further comprise a negative-pressure generator, which is connected to the jet suction box in a flow-carrying manner. The suction-extraction device may also have said recovery unit for the liquid contained in the flow being sucked, especially for the water contained therein. The suction-extraction device may comprise said liquid-permeable, especially perforated conveying device for the fibrous material web. This may be, e.g., the rotatingly driven conveying drum. The suction-extraction device may be arranged at one or more of said injectors. The jet suction box may be arranged in the emission direction of the liquid jets, especially water jets, under the conveying device for the fibrous material web. It may be arranged, in particular, within the rotatingly driven conveying drum.

The hydroentanglement device for the hydroentanglement of a fibrous material web with liquid jets, especially water jets, may comprise the jet suction box and the suction-extraction device. In addition, it may contain one or more injectors as well as a conveying device for the fibrous material web.

The jet suction box being claimed, the suction-extraction device and the suction method have special advantages for said hydroentanglement, especially water jet entanglement, of the fibrous material web. However, they may also be used without such hydroentanglement and without suction-extraction of liquid jets, e.g., for dehumidifying a wet fibrous material web.

Further advantageous embodiments of the present invention are described in the subclaims.

The suction nozzle being claimed, the jet suction box being claimed, the suction-extraction device being claimed, the hydroentanglement device being claimed as well as the suction-extraction method being claimed may have the following additional embodiments, which may be used individually or in a combination.

The following embodiments may be provided in the jet suction box being claimed and in the suction nozzle.

The at least one mobile sealing element may be adjustable at right angles to the suction flow direction. The width of the slot-like suction opening may be variable here.

The adjusting device may comprise at least one adjusting unit, which is arranged in the slot-like suction opening and is accessible from the outside from the inlet side. The adjusting device may comprise in another embodiment at least one adjusting unit, e.g., a clamping strip with screw(s), with which adjusting unit a leaf spring can be clamped at a carrying element and can be adjusted by means of one or more elongated holes at right angles to the suction flow direction.

The nozzle body may have a preferably adjustable opening edge limiter at one or both front ends of the slot-like casing opening and at the at least one mobile sealing device.

The opening edge limiter may comprise a slide, wherein said slide closes the suction opening on the side and on the front side and is guided at the at least one mobile sealing element.

The hollow base part may comprise a support element, which can be arranged above the casing opening, and at least one carrying element. The carrying element may be arranged between the support element and the at least one mobile sealing element. The at least one mobile sealing element may be arranged movably and guided in the suction flow direction on the associated, at least one carrying element.

The at least one mobile sealing element and the associated, at least one, preferably strip-like carrying element may be arranged and guided together movably at right angles to the suction flow direction.

The nozzle body may have a guide device for the at least one mobile sealing element. The guide device may comprise a guide unit, which is arranged between the at least one carrying element and the support element and acts at right angles to the suction flow direction.

The guide device may comprise a guide unit, e.g., one or more elongated holes, which is arranged between the at least one carrying element and a leaf spring and acts at right angles to the suction flow direction.

A resilient sealing apron, which covers a gap between the carrying element and the sealing element, may be arranged on the outside at the at least one carrying element and at the at least one mobile sealing element.

The support element of a hollow base part may have a support cone with sealed cone walls and a cone bottom permeable to the suction flow.

The nozzle body may have closed side walls and closed front walls. It may also have a grip on the front side. The closed side walls may be formed by sealed cone walls of a support cone.

The width of the slot-like suction opening may increase in cross section from the inlet side to the outlet side.

The suction nozzle and the slot-like suction opening as well as the at least one mobile sealing element may be oriented along a suction box axis and at right angles to a motion direction of the fibrous material web.

The suction nozzle and the slot-like suction opening may preferably extend over the entire width or over a partial width of the fibrous material web.

The suction nozzle may be arranged at the jet suction box such that it is located opposite an injector emitting liquid jets, especially water jets, under pressure in the emission direction.

The jet suction box may have a plurality of suction nozzles arranged distributed in the circumferential direction on its box casing. These may be suction nozzles assigned to an injector emitting liquid jets under pressure and/or so-called additional suction nozzles without such an injector assignment.

The jet suction box may be configured as a straight jet suction tube with a cross section that is preferably rotationally symmetrical in at least some areas. The jet suction tube may have a box casing, which is prismatic on the outside, with a flattened portion in the area of the casing opening or an especially cylindrical box casing, which is rounded all round on the outer side.

The nozzle body may extend away from the box casing, especially in the radial direction or in the normal direction.

A plurality of support struts may be arranged preferably in a framework-like arrangement in the slot-like casing opening of the jet suction box.

The jet suction box may have a preferably axial suction opening.

A negative pressure may prevail relative to the surrounding area in the hollow box interior space of the jet suction box. The jet suction box may be connected to a negative-pressure generator and possibly to a recovery unit for the liquid contained in the sucked flow, especially the water contained in it.

The jet suction box may be configured to be arranged within a rotating perforated conveying drum for a fibrous material web, especially in a relatively stationary manner.

The jet suction box may have a bearing surface for a moving conveying device of the fibrous material web, especially for a rotating conveying drum.

The suction-extraction device being claimed may be arranged at an injector emitting liquid jets, especially water jets, under pressure, or it may be configured for such an arrangement.

The hydroentanglement device being claimed may have a conveying device for the fibrous material web.

The present invention is shown in the drawings schematically and as an example. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF PREFERRED EMBODIMENTS

Figure 1:
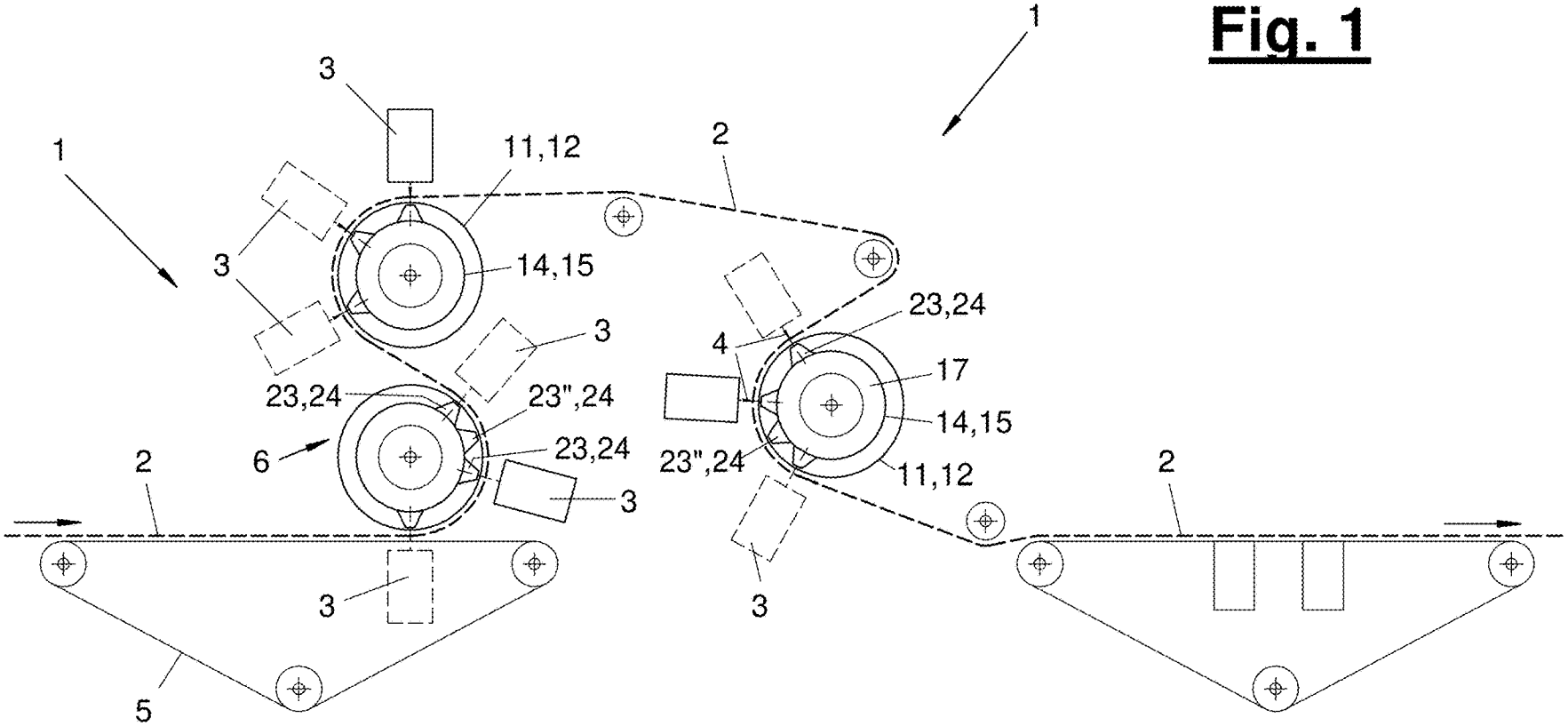
FIG. 1 is a schematic view of a water jet hydroentanglement device with a suction-extraction device and with a jet suction box as well as with a fibrous material web.

Referring to the drawings, the present invention pertains to a suction nozzle (23) as well as to a jet suction box (14) equipped therewith and to a method for the jet suction of high-pressure liquid jets (4) of a hydroentanglement device (1) for liquid jet hydroentanglement, especially water jet hydroentanglement. The present invention also pertains to a suction-extraction device (6) with such a jet suction box (14). The present invention further pertains to a hydroentanglement device (1) with such a jet suction box (14) and with a suction-extraction device (6). In addition, a method for liquid jet hydroentanglement, especially water jet hydroentanglement, and a suction-extraction method belong to the present invention. The present invention also pertains to the dehumidification of a fibrous material web (2) by suction without a high-pressure liquid jet (4) being sucked at the same time.

FIG. 1 shows a plant with, e.g., three hydroentanglement devices (1) for the hydroentanglement of a moving fibrous material web (2) with liquid jets (4), especially with water jets. The fibrous material web (2) consists of textile fibers, especially synthetic fibers. It is configured, e.g., as a nonwoven. It is fed from a production device, not shown, e.g., a card, a spunbond tower, an airlay or the like on a conveying device (5). Additional machines, e.g., a nonwoven layering apparatus, may be inserted as needed. The conveying device (5) may have an endlessly running and jet-permeable conveyor belt. The fibrous material web (2) may pass through the three hydroentanglement devices (1) one after another.

The three hydroentanglement devices (1) may all be of the same type. They have each one or more injectors (3). The injectors (3), which are preferably present as a plurality of injectors, are distributed and arranged one behind the other along the conveying path in the conveying direction of the fibrous material web (2).

The fibrous material web (2) is hydroentangled with thin high-pressure liquid jets (4), especially water jets, arranged in a row or in a matrix, which are emitted each from the injectors (3) towards the fibrous material web (2), and they penetrate these as well as the conveying device (5). The respective injector (3) may be configured, e.g., as a nozzle bar, which is oriented at right angles to the fibrous material web (2) and to the transport path thereof and extends over the fibrous material web (2) over most of the width thereof and preferably completely The emitted liquid jets (4) are taken up with a suction-extraction device (6), sucked in a suction flow and removed. The suction-extraction device (6) has, according to FIGS. 1, 2 and a jet suction box (14) and a conveying device (11) for conveying the fibrous material web (2) in the area of the injector or injectors (3). The jet-permeable conveying device (11) supports the fibrous material web (2) lying above it against the impinging liquid jets (4).

The jet suction box (14) sucks the liquid jets (4) leaving again the fibrous material web (2) and the conveying device (11) with a suction flow. In addition, air can be sucked in from the outside area surrounding the fibrous material web (2). The jet suction box (4) is arranged beneath the conveying device (11) in the emission direction of the liquid jets (4) shown in FIGS. 1 and 9. The jet suction box (14) is arranged relatively stationary in relation to the moving conveying device (11).

The jet suction box (14) is configured in the exemplary embodiments shown as a long and straight jet suction tube (15) with a cross section that is preferably rotationally symmetrical in at least some areas. The jet suction tube (15) may have, e.g., an essentially cylindrical shape. Another configuration, e.g., in a cuboid box-shaped form, is possible as an alternative. The features described below in connection with the jet suction tube (15) correspondingly apply to other types of jet suction boxes (14) as well.

Figure 2:
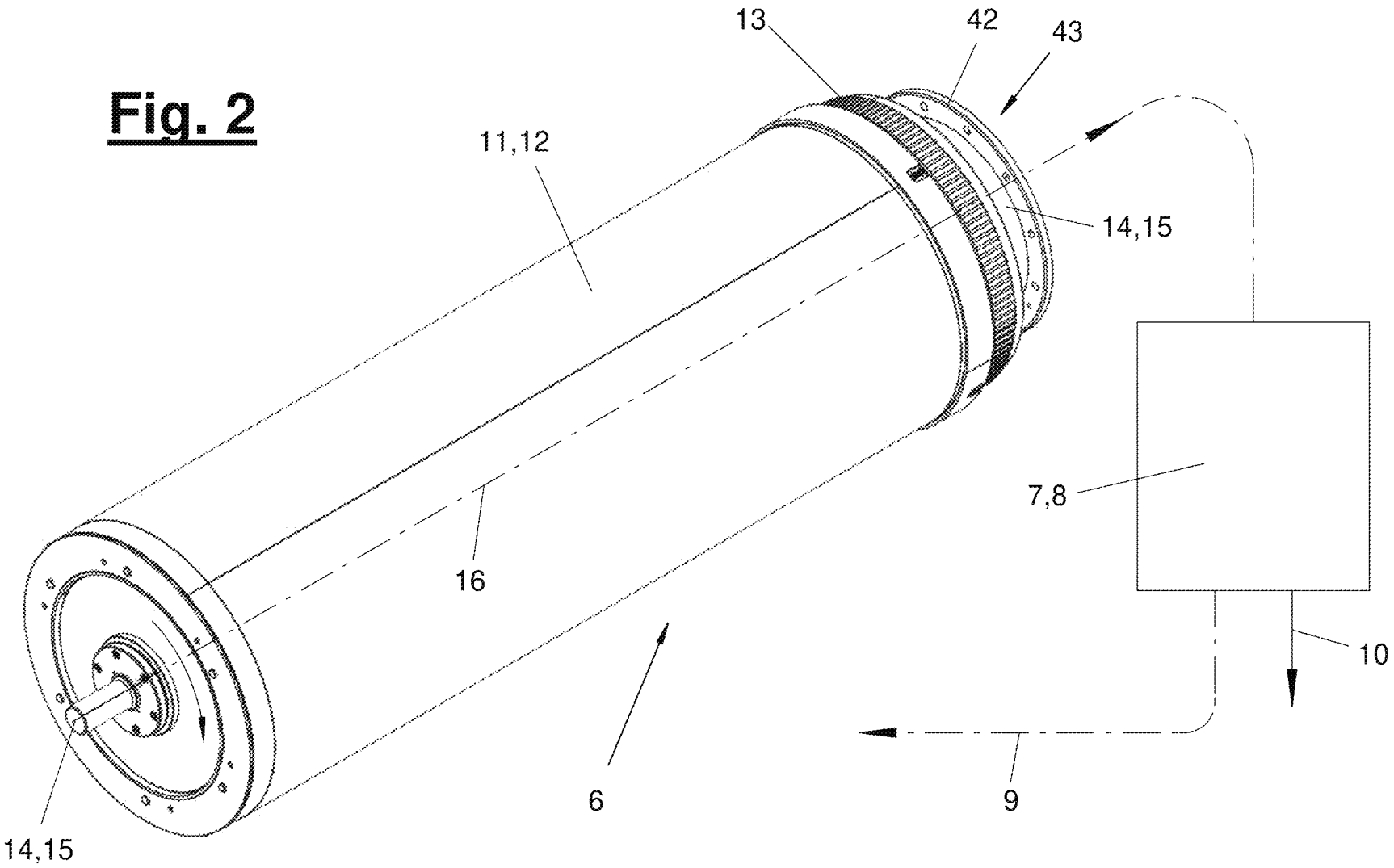
FIG. 2 is a perspective view of the arrangement of a jet suction box configured as a jet suction tube with an enclosing rotating conveying drum.

The conveying device (11) is configured in the exemplary embodiments shown as a rotatingly driven, cylindrical conveying drum (12), in which the jet suction box (14) or the jet suction tube (15) is arranged in a relatively stationary manner. The conveying drum (12) is arranged concentrically to the central axis (16) of the jet suction tube (15) and rotates about this axis (16). The conveying drum (12) may be driven rotatingly in any desired and suitable manner. A drive (13) is provided for this purpose, and, for example, a gear ring of this drive, which gear ring is arranged at a front end of the conveying drum (12), is shown in FIG. 2. The other parts of the drive (13), e.g., a motor with gear mechanism and output gear, etc., are not shown.

The conveying device (11) has a fluid- and jet-permeable configuration. It lets the liquid jets (4) and also air pass through. The conveying device (11) may have for this purpose, for example, a punctured or perforated conveying element. Shown as a conveying drum (12) in the embodiment, the drum casing is permeable to fluids.

In another variant, not shown, the conveying device (11) may be configured in a different manner, e.g., as an endlessly running belt conveyor. This endlessly running belt conveyor may likewise be liquid-permeable and may have, e.g., a punctured or perforated conveyor belt. A belt conveyor may cooperate with, e.g., a cuboid jet suction box (14)

In the embodiments shown, the conveying drum (12) has a punctured, especially perforated, cylindrical casing, through the openings of which the liquid jets (4) can reach the jet suction box (14) or the jet suction tube (15). A negative pressure, by which the emitted liquid jets (4) can be sucked into the hollow box interior space (17) efficiently and in a targeted manner, can be generated in the jet suction tube (15). The jet suction tube (15) is closed at a front end and has at the other end a suction opening (43), through which the sucked liquid/air mixture can again leave the box interior space (17).

The fibrous material web (2) twines itself around the conveying drum (12) over a large part of the circumference thereof. The fibrous material web (2) can be conveyed by the rotation of the drum and can also be transferred to the next conveying drum (12) as well as transferred again to a conveyor belt or to another device for removal after passing through the last hydroentanglement device (1). The fibrous material web (2) may lie directly on the drum casing. As an alternative, the moving conveyor belt may be arranged in between.

An injector (3), whose emitted liquid jets (4) pass through the conveyor belt, is arranged under the conveyor belt (5) and at the transfer site at which the fibrous material web (2) is transferred to the first suction-extraction device (6). These liquid jets additionally carry and transfer the fibrous material web (2) to the first conveying drum (12). FIG. 1 shows this arrangement.

Figure 4:
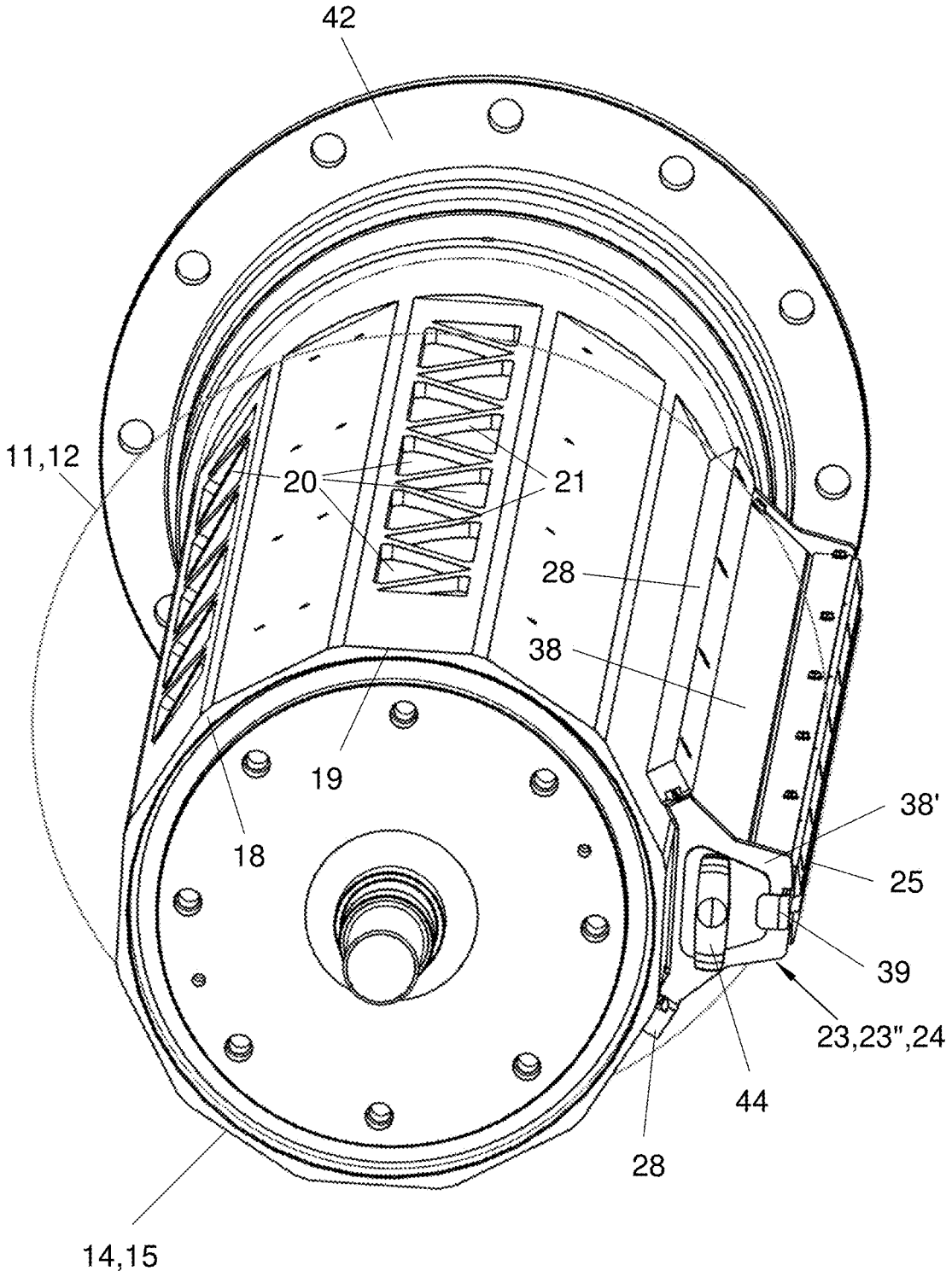
Figure 5:
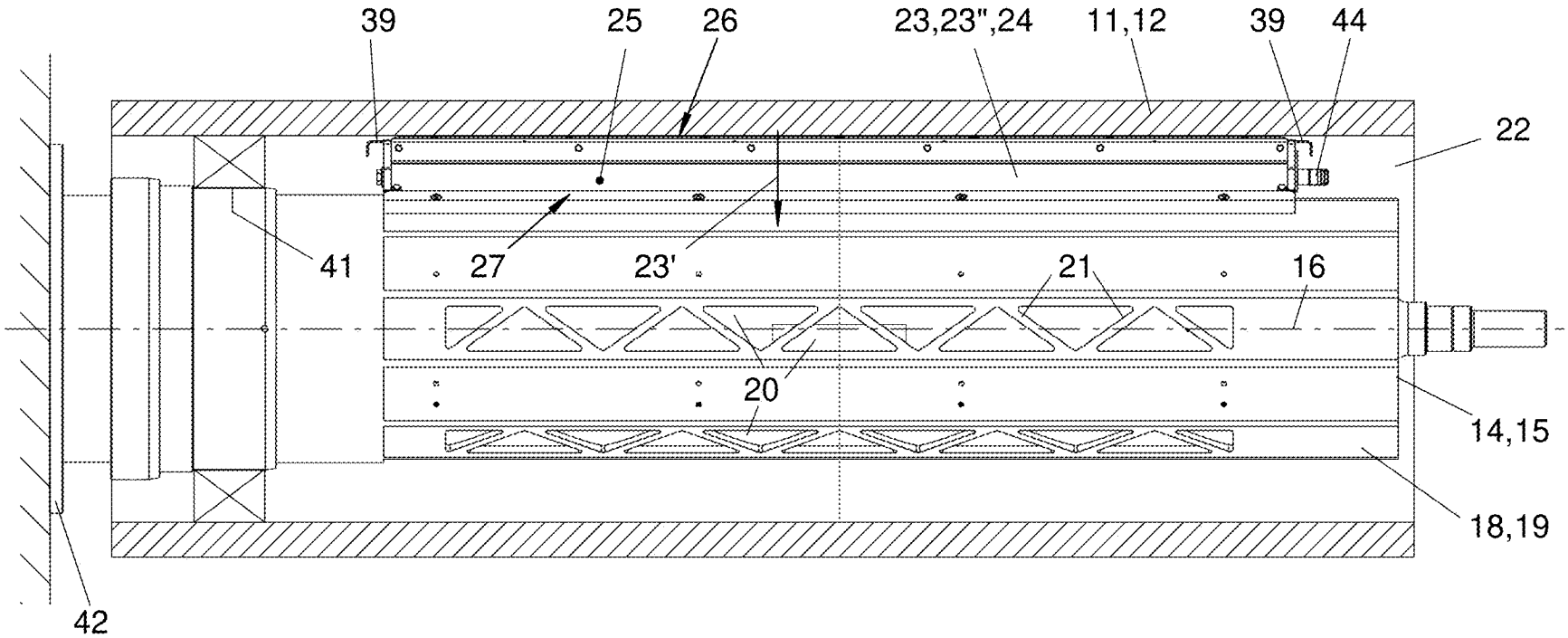
FIG. 5 is a side cut-away view of the jet suction tube with a conveying drum.
Figure 6:
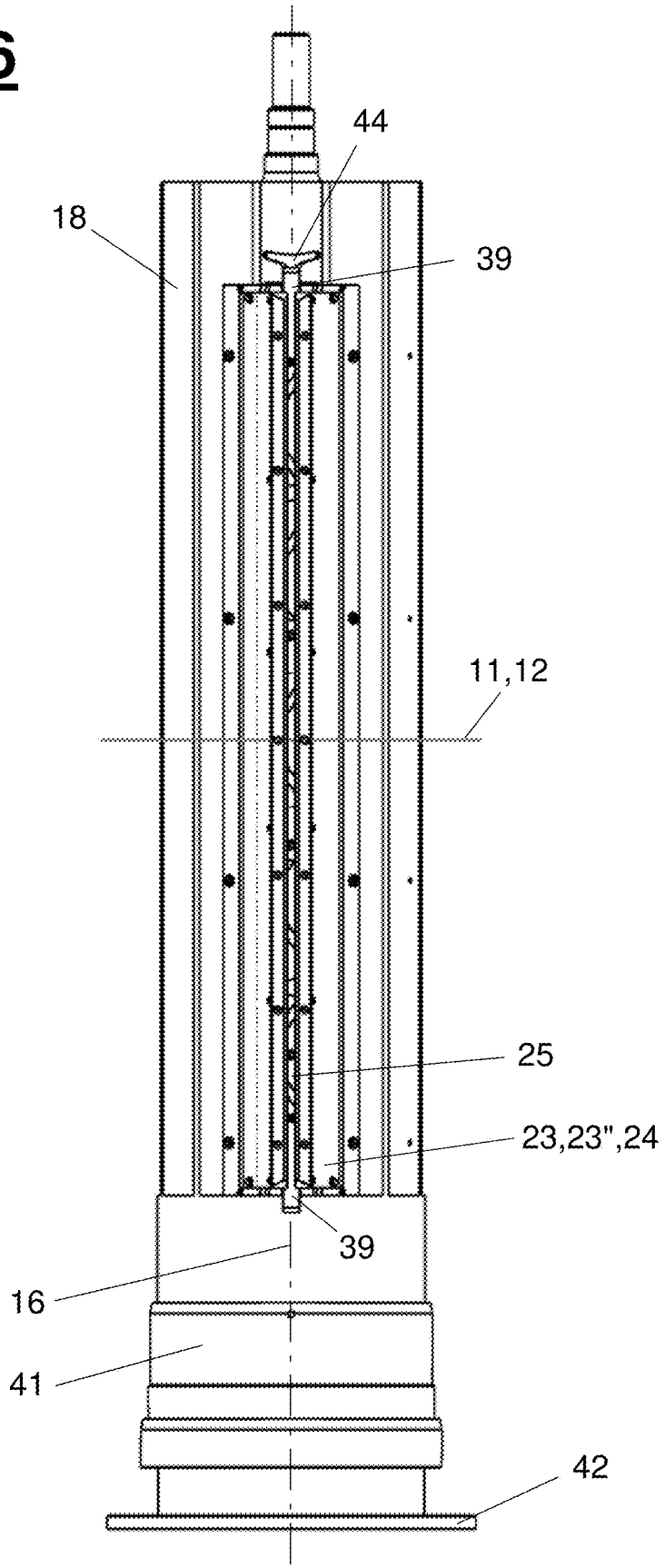
FIG. 6 is a top view of the jet suction tube.
Figure 7:
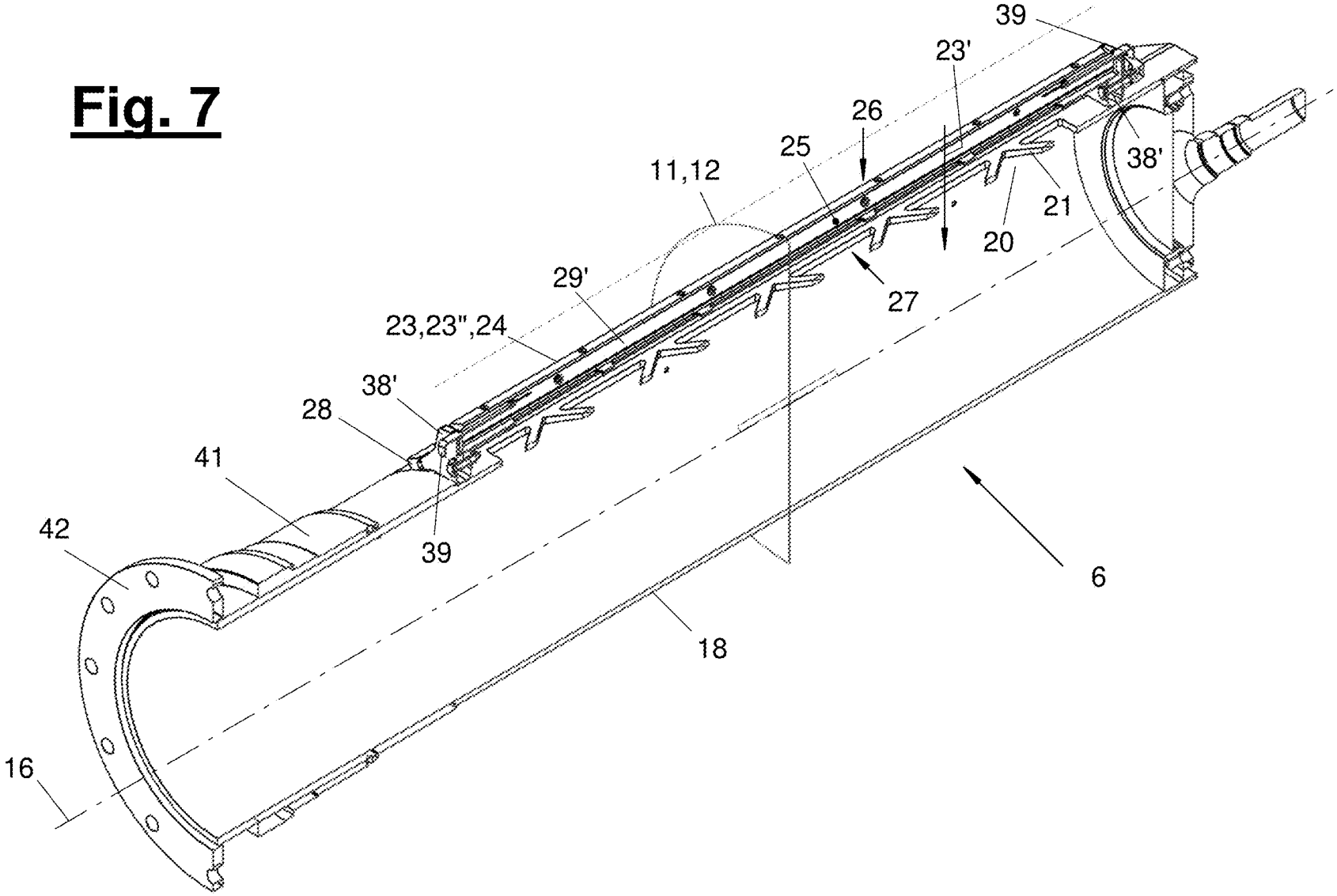
FIG. 7 is a perspective central longitudinal sectional view of the jet suction tube and of the suction nozzle.
Figure 9:
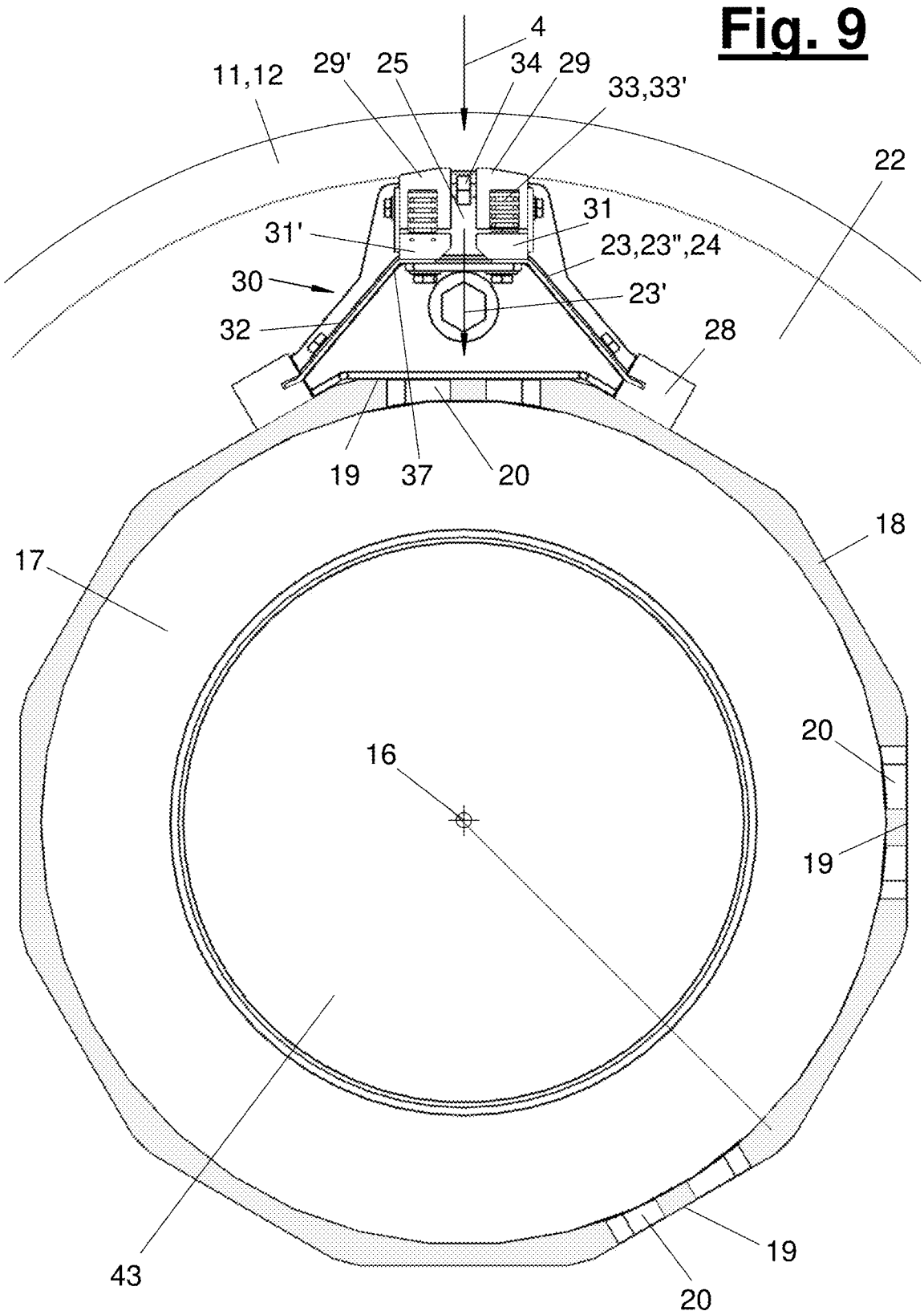
FIG. 9 is a cross sectional view of the jet suction tube and of the suction nozzle.

FIGS. 2 and 5 schematically show additional components of the suction-extraction device (6). The conveying drum (12) is mounted rotatably, e.g., on the jet suction tube (15). The jet suction tube (15) may have for this purpose bearing surfaces (41) at the front-side ends, which are shown in FIGS. 2 through 5. An intermediate space (22), which may correspond to the radial space required for mounting the drum, may be present between the jet suction tube (15) and the conveying drum (12). FIGS. 5 and 9 show this arrangement. The jet suction tube (15) has a vertical journal at the closed front end and a tube flange (42) for the stationary mounting at the other open (43) front-side end.

The suction-extraction device (6) has a negative-pressure generator (7), with which the liquid/air mixture is drawn off from the jet suction tube (15) through the opening (43) and through a connecting line. The suction-extraction device (6) may further have a recovery unit (8), with which the liquid is separated from the air and can be fed again via a return (9) as well as possibly a purification device to the one or more injectors (3). The air may be released via an outlet (10). The negative-pressure generator (7) and the recovery unit (8) are suggested only schematically in FIG. 2. They may have any desired and suitable configuration and arrangement. The recovery unit (8) may be configured, e.g., as a cyclone.

FIGS. 3 through 14 show in a first variant the configuration of the jet suction box (14) and of the jet suction tube (15). The conveying device (11), especially the conveying drum (12), is suggested here. Another variant is shown in FIGS. 15 through 20.

The hollow jet suction tube (15) has a box casing (18) or tube casing, which has a cylindrical cross section on the inner side and a prismatic shape with a plurality of flattened portions (19) on the outside. FIGS. 4 and 9 show this embodiment The jet suction tube (15) has at least one suction nozzle (23, 23") with a slot-like suction opening (25) on its box casing (18). The suction nozzle (23, 23") and its slot-like suction opening (25) extend along the axis (16) of the jet suction box (14), especially the central longitudinal axis (16) of the jet suction tube (15). They further extend preferably over the entire width of the fibrous material web (2)

The number and the arrangement of the suction nozzles (23) may depend on the number and the arrangement of the one or more injectors (3). In the exemplary embodiment shown, e.g., three injectors (3) are arranged in the arch around the conveying drum (12) and the jet suction tube (15) in a hydroentanglement device (1). The arrangement in an arch and the emission direction of the liquid jets (4) may be concentrical to the axis (16).

The suction nozzles (23) may be arranged in a corresponding number and distribution at the box casing (18) of the jet suction tube (15). They point with their suction openings (25) towards the respective associated injector (3) and are located opposite to this in the emission direction. The liquid jet (4) emitted from the respective injector (3) reaches the suction opening (25) directly after passing through the fibrous material web (2) and the conveying device (11, 12) and is sucked in a suction flow with a suction flow direction (23'). This fact is indicated by arrows in FIG. 9.

The suction nozzles (23) and the injectors (3) are arranged in the area in which the fibrous material web (2) twines itself around the conveying device (11, 12) and is in contact with same.

FIG. 1 shows, in addition, the possibility of an arrangement of additional suction nozzles (23") at the jet suction box (4), which are not associated with an injector (3). The suction nozzles (23, 23") may have all the same configuration. The additional suction nozzles (23") may additionally dehumidify the fibrous material web (2). They are likewise arranged in said twining-around and contact area.

The suction flow direction (23') and the vertical axis of the suction opening (25) are oriented radially in relation to the axis (16). The penetration of the respective liquid jets (4) into the suction opening (25) is supported by the negative pressure in the box interior space (17) and by the suction effect. In addition, air is sucked in from the outer side of the fibrous material web (2) through the suction opening (25) and is entrained with the liquid jets (4) while the suction flow is formed.

The three suction nozzles (23) arranged at the box casing (18) distributed in the circumferential direction in the exemplary embodiments shown are configured each as a nozzle attachment with a nozzle body (24), which is arranged above an axial casing opening (20) in the box casing (18). The nozzle body (24) projects outwards away from the box casing (18) in the radial direction and reaches according to FIGS. 1, 5, 8 and 9 up to the conveying device (11), especially to the conveying drum (12), and is in close contact there. The other suction nozzles (23") may be configured in the same manner.

The preferably slot-like casing opening (20) extends along the axis (16) in the box casing (18). It extends over the width of the material web and ends in front of the front-side edges of the jet suction tube (15). A plurality of support struts (21) are arranged in the slot-like casing openings (20). The arrangement may have an oblique orientation and have a framework-like configuration. The slot-like casing opening (20) may extend over the entire width of the material web or over one or more partial areas of the width of the material web. The slot-like casing opening (20) may be present continuously or it may be arranged and interrupted in some areas.

The slot-like suction opening (25) passes through the respective nozzle body (24) in a suction flow direction (23'), the inlet side (26) of the suction opening (25) being arranged at the free end of the nozzle head (24) as well as pointing outwards, and wherein the outlet side (27) thereof is directed towards the casing opening (20). As is shown in FIG. 9, the suction opening (25) has in the cross section a width that increases from the inlet side (26) towards the outlet side (27).

On the inlet side (26), the nozzle body (24) has at least one mobile sealing element (29, 29'), which is arranged next to the suction opening (25) and laterally defines the slot-like suction opening (25). Mobile sealing elements (29, 29') are arranged in the exemplary embodiments shown on both sides of the suction opening (25). The mobility is present along the suction flow direction (23'). The one or more sealing elements (29, 29') have a strip-shaped and preferably one-piece configuration. They extend along the axis (16). FIGS. 3 through 14 and FIGS. 15 through 20 show different embodiments of sealing elements (29, 29').

The nozzle body (24) further has a resilient expansion device (33) acting on the at least one sealing element (29, 29'). This expansion element is configured to push the sealing element (29, 29') away from the casing opening (20) against the suction flow device (23') to the outside and against the conveying device (11), especially the rotating conveying drum (12). The at least one mobile sealing element (29, 29') is tightly in contact under spring force with the inner side of the conveying device (11), especially the conveying drum (12). Due to the close contact, the suction of infiltrated air from the intermediate space (22) into the nozzle body (24) and into the suction opening (25) is prevented.

The at least one mobile sealing element (29, 29') can move along the suction flow direction (23') under the effect of the resilient expansion device (33). It has a shape favorable for sealing on its outer side pointing towards the conveying device (11). It may have, e.g., a bevel shown in FIG. 9 or a rounding or the like on the outer side. The at least one sealing element (29, 29') may have a surface consisting of a low-friction material at least on this outer side.

The resilient expansion device associated with the respective sealing element (29, 29') comprises a plurality of compression springs (33') in the exemplary embodiments shown in FIGS. 3 through 14. These have an extension and an action direction along the direction (23') of the suction jet. The compression springs (33') are accommodated, e.g., in lower blind holes of the at least one sealing element (29, 29').

The compression springs (33') are compressed in the exemplary embodiments shown during the assembly of the jet suction box (14) at the conveying device (11), especially in the rotating conveying drum (12), and they develop the resilient pressing force, with which the respective mobile sealing element (29, 29') is pressed sealingly against the conveying device (11) or the conveying drum (12).

In another embodiment, not shown, the respective resilient expansion device (33) may be expandable in a switchable and/or controlled manner. Instead of the compression springs (33'), it may have expanders (33"), e.g., pressure rams or cylinders, to which compressible pressurized medium, especially pressurized gas, can be admitted in a switchable or controlled manner. In another variant according to FIGS. 15 through 20, the resilient expansion device (33) may have an expander (33") inflatable with such a compressible pressurized medium, especially pressurized gas, e.g., in the form of a flexible pressure tubing or pressure bellows, which extends along the axis (16) in at least some areas and which expands or is expanded during the inflation and admits pressure to and moves the associated sealing element (29, 29') directly or indirectly.

The expansion device (33) configured as an expander (33") becomes smaller on switching off such that the sealing element (29, 29'), to which pressure is admitted, loses its pressing force at the conveying device (11) or at the conveying drum (12) and possibly also moves away from same in the suction flow direction (23'). The resilient expansion and pressing force acting on the sealing element (29, 29') can be set and changed as needed due to a controlled admission of pressure to the expansion device (33) or expander (33").

The at least one sealing element (29, 29') may additionally be arranged at the nozzle body (24) laterally and in a transversely movable manner in relation to the suction flow direction (23'). The width of the suction opening (25) can be changed by this lateral motion in the area of the movable sealing element or sealing elements (29, 29').

The nozzle body (24) has an adjusting device (34), with which the at least one mobile sealing element (29, 29') can be adjusted at right angles to the suction flow direction (23'). The slot width of the suction opening (25) can be changed hereby.

The adjusting device (34) comprises, e.g., at least one adjusting unit (34'), which is arranged in the slot-like suction opening (25) and which is accessible from the outside from the inlet side (26). As is shown in FIGS. 10 through 14, a plurality of adjusting units (34') are arranged one after another at spaced locations along the axis (16). They are configured, e.g., as adjusting screws of variable lengths, which act on the sealing elements (29, 29') arranged on both sides and whose length can be changed by means of a wrench inserted into the suction opening (25).

The nozzle body (24) has a guide device (34) for the at least one mobile sealing element (29, 29'). The guide device (35) can guide the one or more sealing elements (29, 29') during their motions along and at right angles to the suction flow direction (23').

In the exemplary embodiments shown, the nozzle body (24) has a hollow base part (30), on which the at least one mobile sealing element (29, 29') is arranged. The suction opening (25) also passes through the hollow base part (30) and it extends up to the box casing (18) and to the casing opening (20). It may be mounted and supported at the box casing (18), e.g., in the area of a possibly different flattened portion (19). The resilient expansion device (33) is arranged between the base part (30) and the associated, at least one mobile sealing element (29, 29'). The guide device (35) may likewise be arranged between the base part (30) and the at least one mobile sealing element (29, 29').

In the exemplary embodiments shown in FIGS. 3 through 14, the hollow base part (30) comprises a support element (32) arranged above the casing opening (20) and at least one carrying element (31, 31'). This at least one carrying element (31, 31') is arranged between the support element (32) and the respective associated, at least one mobile sealing element (29, 29').

Figure 8:
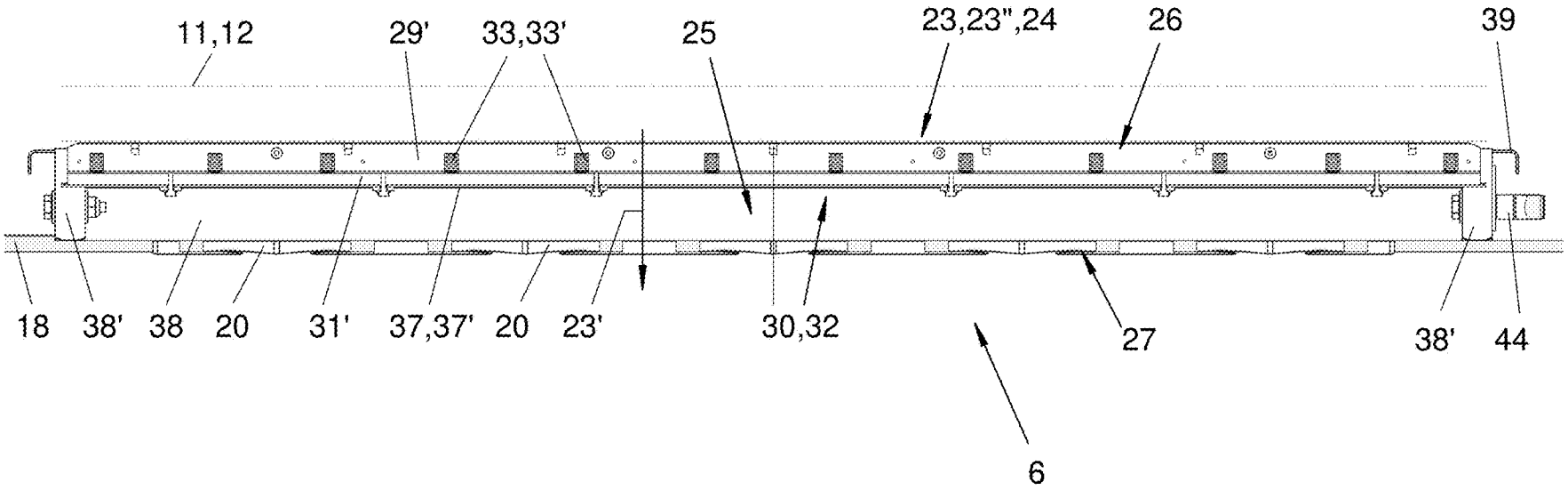
FIG. 8 is a cut-away longitudinal sectional view of the jet suction tube and of the suction nozzle according to section line VIII-VIII in FIG. 6.

Said carrying element (31, 31') likewise has a strip-like configuration and extends along the slot-like suction opening (25) and the axis (16). The at least one mobile sealing element (29, 29') is arranged at the associated carrying element (31, 31'). It floats at a spaced location above the associated carrying element (31, 31') and is carried by the resilient expansion device (33), especially the compression springs (33'). The resilient expansion device (33), especially the compression springs (33'), is/are supported now on the corresponding carrying element (31, 31'). FIGS. 8 and 9 show this configuration and arrangement.

Figure 10:
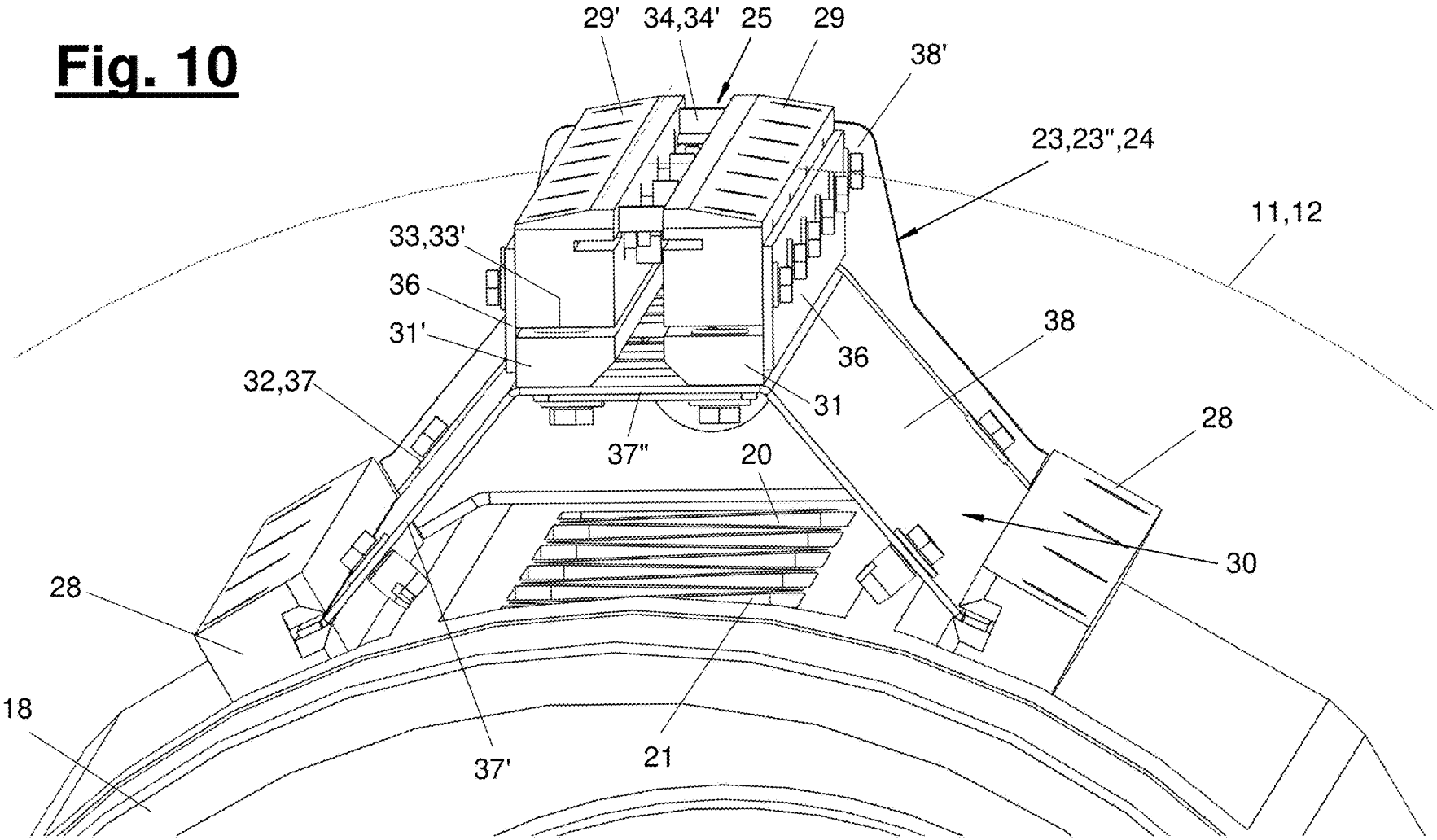
FIG. 10 is a perspective front view of the suction nozzle.

As is shown in FIG. 10, the inner sides of the at least one mobile sealing element (29, 29') and of the associated carrying element (31, 31'), which said inner sides are directed towards the suction opening (25), are flush with one another in the suction flow direction (23'). The outer sides of the at least one mobile sealing element and of the associated carrying element, which outer sides face away from the suction opening (25), are likewise flush with one another in the suction flow direction (23').

A respective carrying element (31, 31') each is associated with the two mobile sealing elements (29, 29') in the exemplary embodiments shown.

Figure 13:
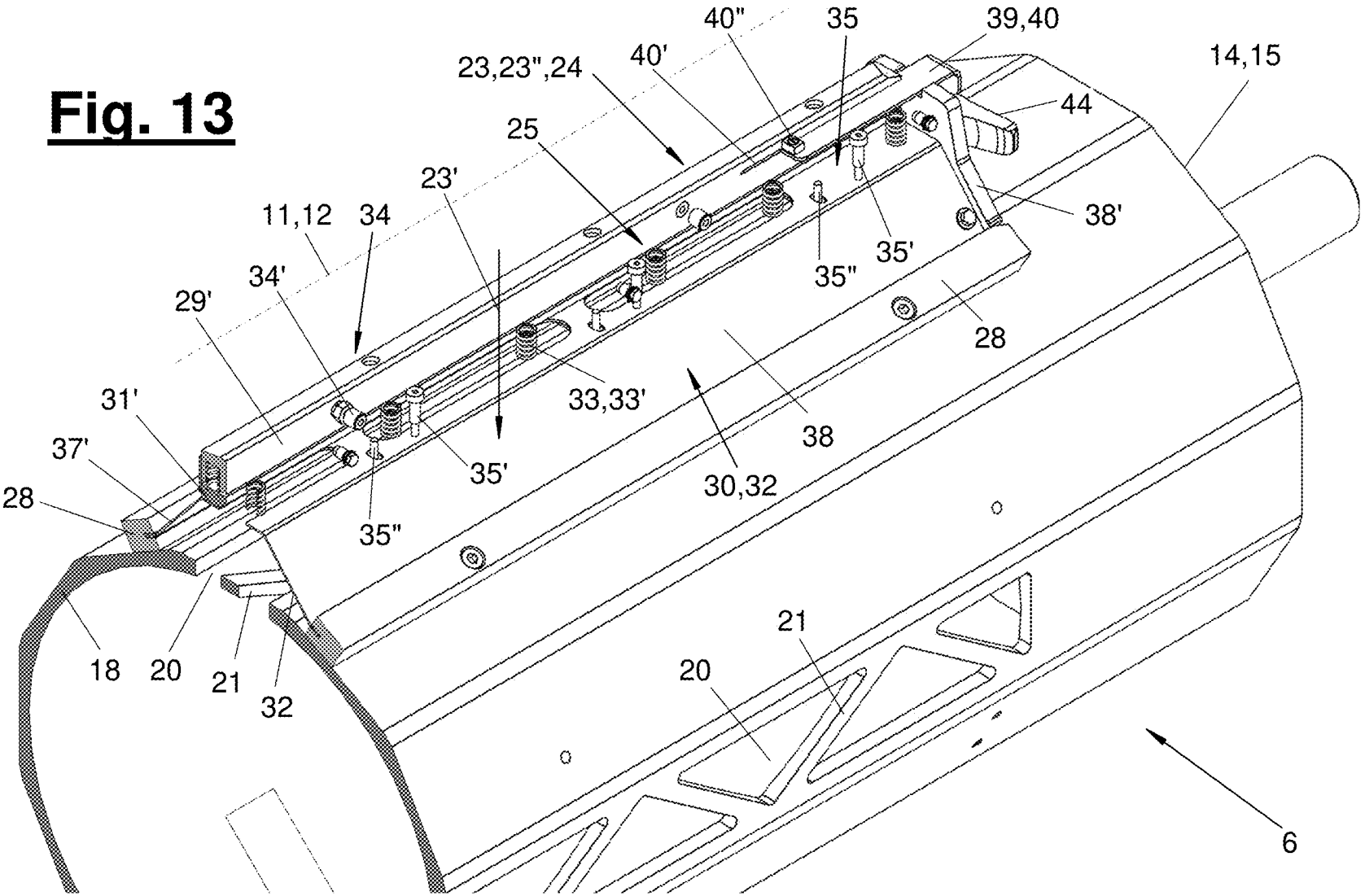
FIG. 13 is a cut-away and enlarged perspective longitudinal sectional view of the jet suction tube and of the suction nozzle.

The one or more sealing elements (29, 29') and carrying elements (31, 31') associated with one another are connected each to one another, e.g., such that they are arranged movably together at right angles to the suction flow direction (23') and are mounted at the support element (32). FIGS. 10 and 13 show this configuration, FIG. 13 showing only the one sealing element (29') and the associated carrying element (31').

The guide device (35) has in the exemplary embodiments shown a respective guide unit (35'), which is arranged between the respective, at least one mobile sealing element (29, 29') and the at least one carrying element (31, 31') and which acts along the suction flow direction (23'). The guide unit (35') is present, e.g., according to FIGS. 13 and 14, as a plurality of guide units and these are arranged in a distributed manner along the slot-like suction opening (25). The guide units (35') are configured, e.g., as straight guide rods or guide pins. These mesh with corresponding guide openings at at least one sealing element (29, 29').

Figure 14:
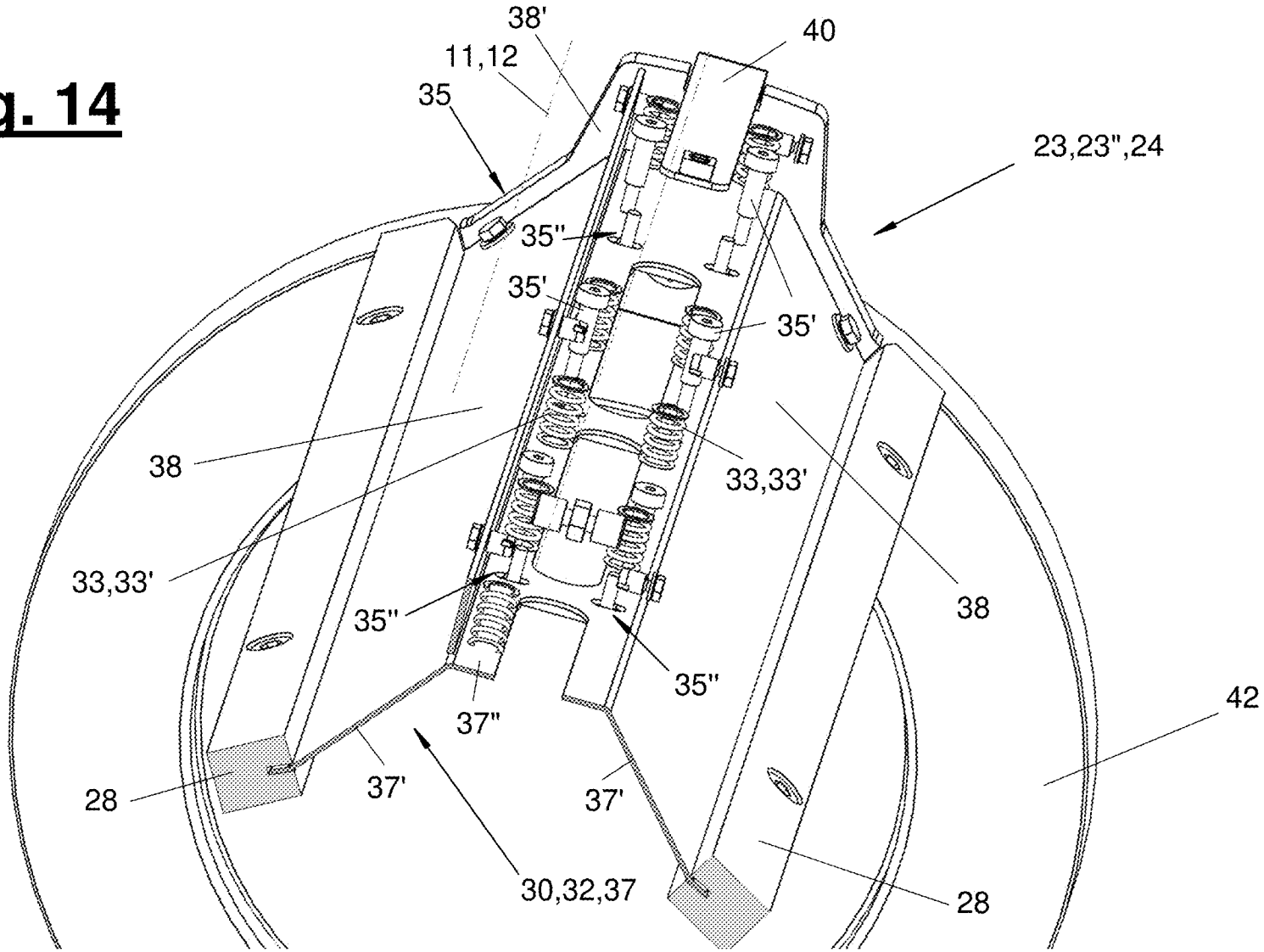
FIG. 14 is another cut-away perspective view of the suction nozzle.

The guide device (35) further has at least one guide unit (35"), which is arranged between the at least one carrying element (31, 31') and the support element (32) and acts at right angles to the suction flow direction (23'). As is shown in FIGS. 13 and 14, the guide unit (35") is likewise present as a plurality of guide units and these are arranged distributed along the slot-like suction opening (25). It guide unit is formed by a downward extending guide rod at the respective carrying element (31, 31') and an elongated hole directed at right angles to the suction flow direction (23') at the support element (32). The guide rod meshes with the corresponding elongated hole and is guided there during its transverse motion. FIG. 14 shows in an abstracted view the guide units (35, 35") and the resilient expansion device (33), especially compression springs (33') without the sealing and carrying elements (29, 29', 31, 31'). In addition, the adjusting units (34') are shown in FIGS. 13 and 14.

Figure 11:
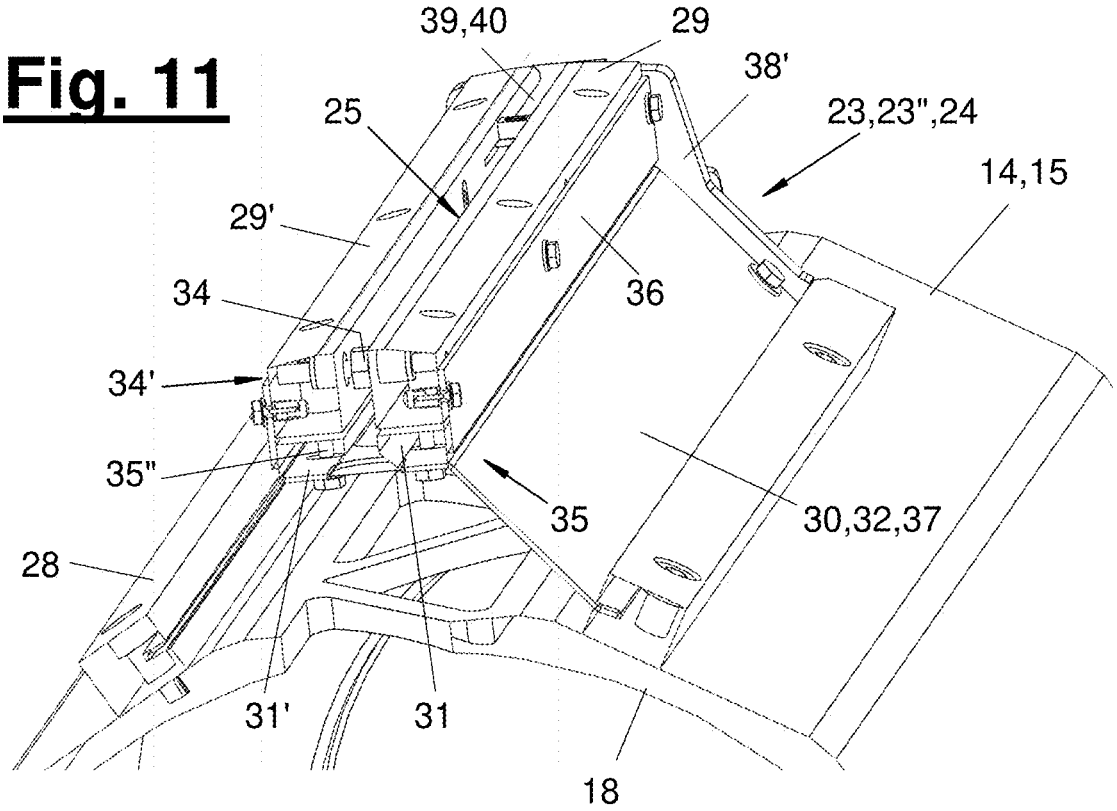
FIG. 11 and FIG. 12 are different perspective cross-sectional views of the suction nozzle.
Figure 12:
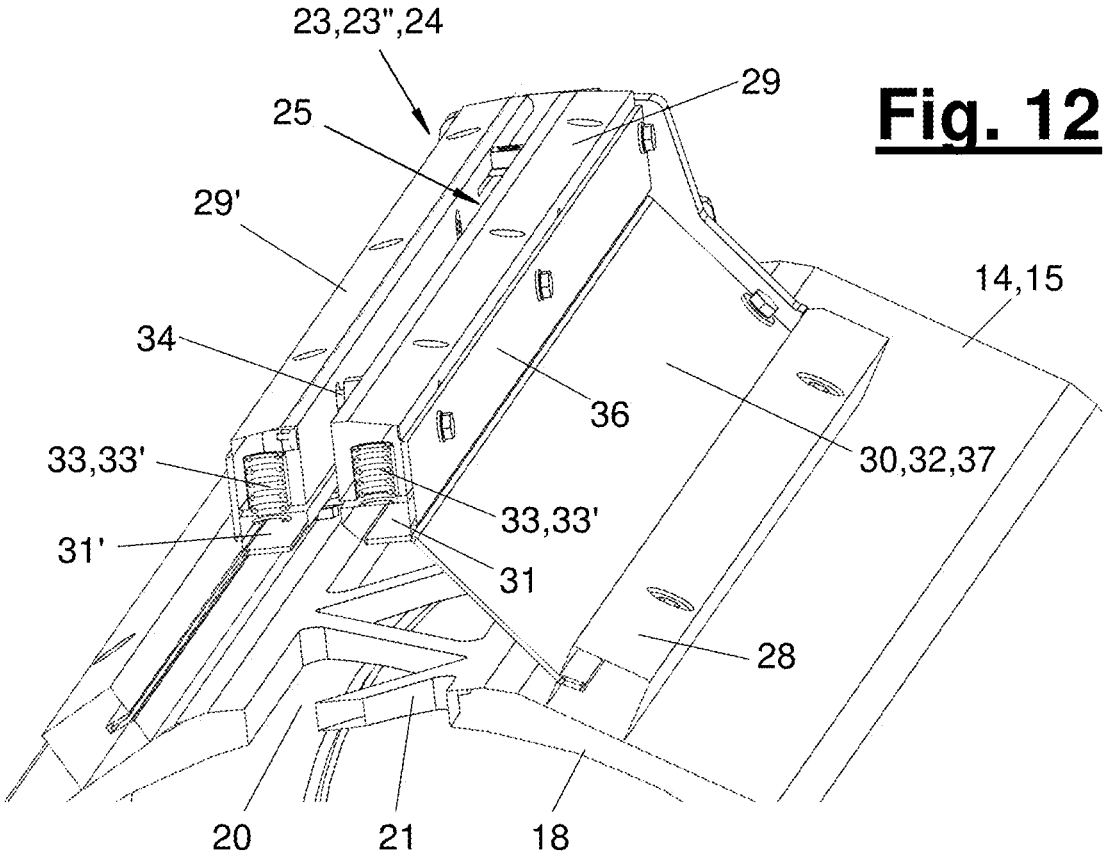

FIG. 10 shows an opened front view of the nozzle body (24) and the suction nozzle (23, 23'). FIGS. 11 and 12 show perspective cross-sectional views of the jet suction box (14) and of the nozzle body (24) at different locations along the axis (16) and the suction opening (25). The adjusting units (34') can be seen in FIG. 11 and the resilient expansion device (33), especially compression springs (33'), are visible in FIG. 12.

FIGS. 10 through 12 show, in addition, the arrangement of a resilient sealing apron (36) on the outer sides of the at least one carrying element (31, 31'), which outer sides face away from the suction opening (25), and at the at least one mobile sealing element (29, 29'). The sealing apron (36), which consists of, e.g., rubber, covers the gap between the carrying element (31, 31') and the associated sealing element (29, 29') and seals this gap during a relative motion between the respective sealing element (29, 29') and the associated carrying element (31, 31'). The resilient expansion devices (33) are supported at the associated carrying element (31, 31') during this relative and expansion motion. During the adjustment of the width of the suction opening (25), the one or more sealing elements (29, 29'), to which pressure is admitted by the adjusting units (34'), carry the respective associated carrying element (31, 31') via the guide unit (35').

In the exemplary embodiments shown, the support element (32) has a support cone (37), which is arranged above the casing opening (20) and expands in the direction of the casing opening (20). The support cone (37) has sealed and preferably thin cone walls (37') and a cone bottom (37"), which is permeable to the suction flow and which is arranged at a spaced location above the casing opening (20). The suction opening (25) widens to an especially great extent in the area of the support cone (37). The lower opening width of the support cone (37) may be greater than the width of the casing opening (20).

Over its length along the axis (16), the cone bottom (37") has a plurality of passage openings for the suction flow and cross webs arranged between them. The guide units (35") can act at the cross webs. On both sides of the passage openings, there are wall areas at which the resilient expansion devices (33), especially compression springs (33'), are supported. FIG. 14 shows this configuration and arrangement.

The nozzle body (24) has an adjustable opening edge limiter (39) at one or both front ends of the slot-like suction opening (20) and at the at least one mobile sealing device (29, 29'). This opening edge limiter closes the suction opening (25) at its edge area in the suction flow direction (23') and also closes it on the front side.

The opening edge limiter (39) comprises, e.g., a slide (40), which is displaceable along the axis (16) and the casing opening (20). As a result, a smaller or larger area of the suction opening (25) can be covered and closed at its edge depending on the position of the slide. The slide (40) is inserted at the preferably two sealing elements (29, 29') in slotted guides (40') located there and is guided axially. It projects on the front side beyond the nozzle body (24) and has a grip part at this location. An upwardly projecting projection (40"), which reaches between the sealing elements (29, 29') located on both sides and closes here the suction opening (25) on the front side, is arranged at the opposite end of the slide (40). FIG. 13 shows the configuration and the arrangement of the opening edge limiter (39).

The nozzle body (24) is arranged movably and especially displaceably at the box casing (18) by means of a bracket (28). The bracket (28) is formed, e.g., by two slotted guide strips, which are oriented along the axis (16) and which are arranged on both sides of the casing opening (20) and are mounted stationarily at the box casing (18), e.g., at a flattened portion (19). The nozzle body (24) meshes with the slot-like mounts of the guide strips. The cone walls (37') are correspondingly bent at an angle at the end for this purpose in the exemplary embodiments shown.

In addition, the nozzle body (24) is provided with a grip (44) on a front side. The nozzle body (24) can thus be pushed axially into the bracket (28) and pulled out. This is carried out, e.g., according to FIG. 5 on the side of the nozzle body (24) facing away from the flange (42). The nozzle body (24) can also be pulled out on this side from the overlap with the conveying device (11), especially the conveying drum (12), and it is then accessible from the outside. In particular, the adjusting device (34) can then be readily reached and operated. The one or more resilient expansion devices (33) may possibly be switched off during the pushing in and pushing out of the nozzle body (24).

Figure 3:
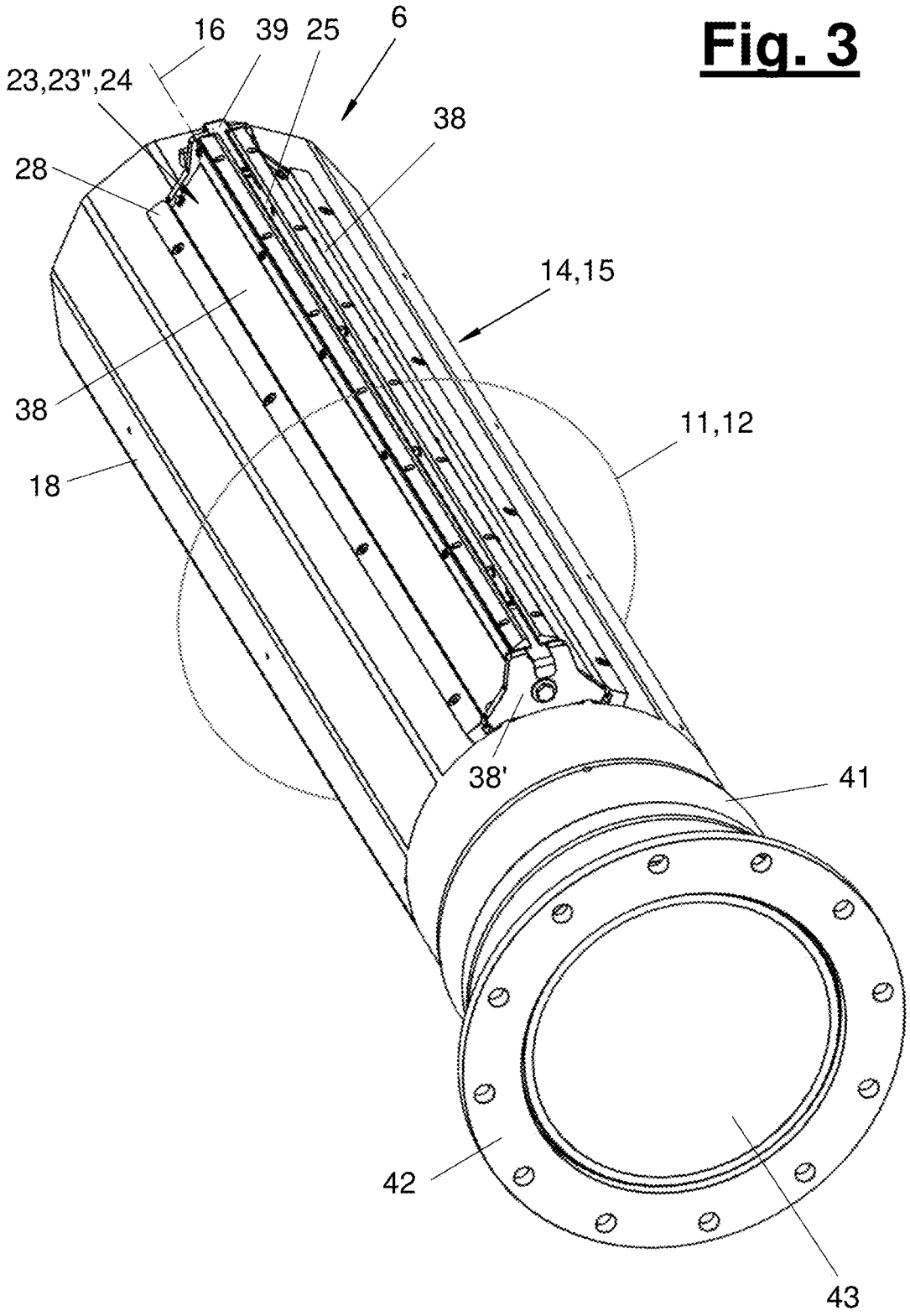
FIG. 3 and FIG. 4 are perspective views of the jet suction tube with axially oriented suction nozzles according to FIG. 1.

The nozzle body (24) has, according to FIGS. 3 and 4, closed side walls (38) and closed front walls (38'). The side walls (38) are formed, e.g., by the cone walls (37'), the respective carrying element (31, 31') and the respective mobile sealing device (29, 29') and possibly the sealing apron (36). The front walls (38') may be mounted at the front ends of the hollow base part (30). They seal the suction opening (25). The slide (40) may be located above the respective front wall (38').

FIGS. 15 through 20 show the above-mentioned further variant of the suction nozzle (23, 23") and of the jet suction box (14) equipped therewith as well as of the suction-extraction device (10) configured therewith.

Figure 15:
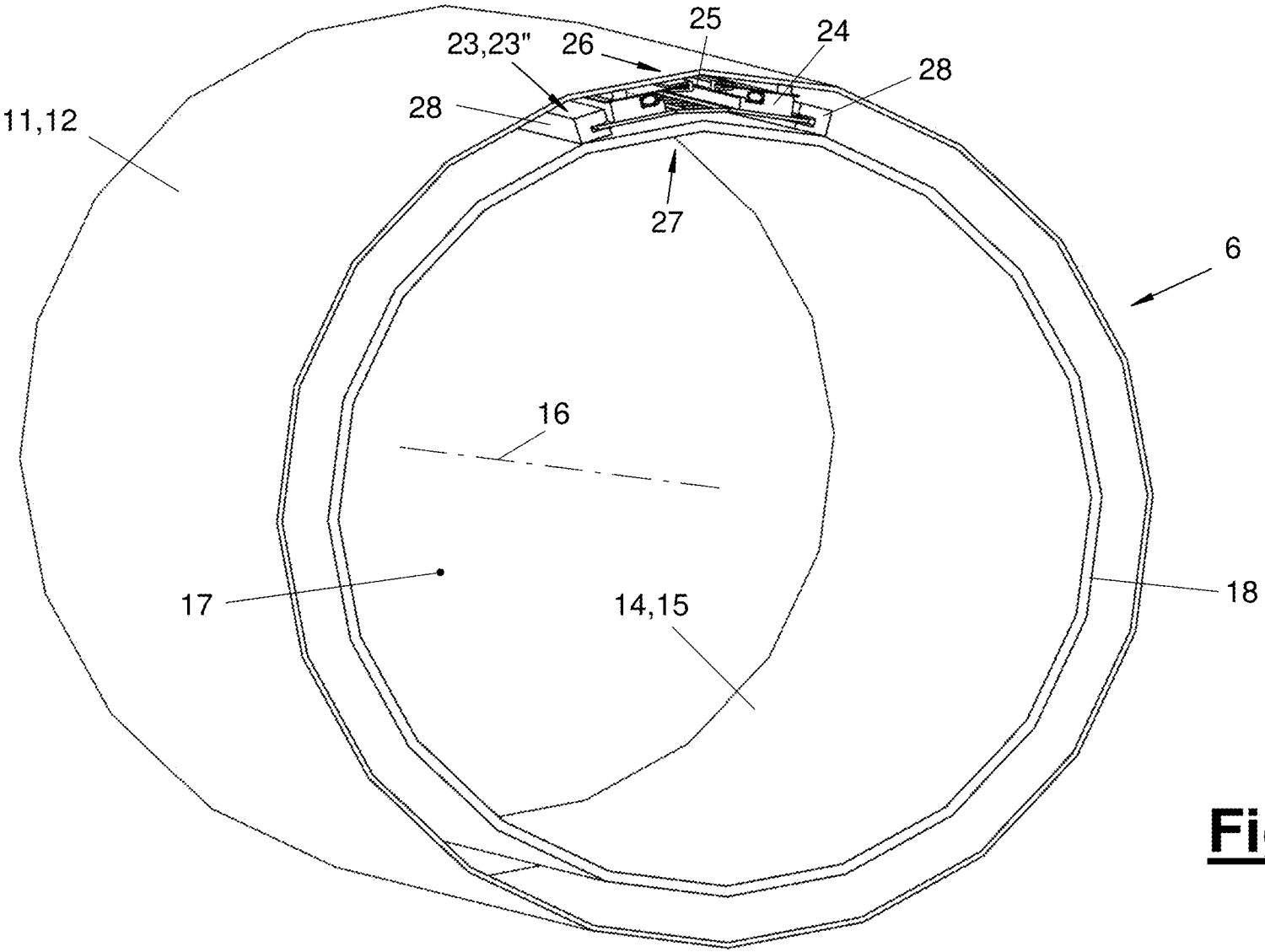
FIG. 15, FIG. 16, FIG. 17, FIG. 18, FIG. 19 and FIG. 20 are different views of another embodiment of the suction nozzle.
Figure 16:
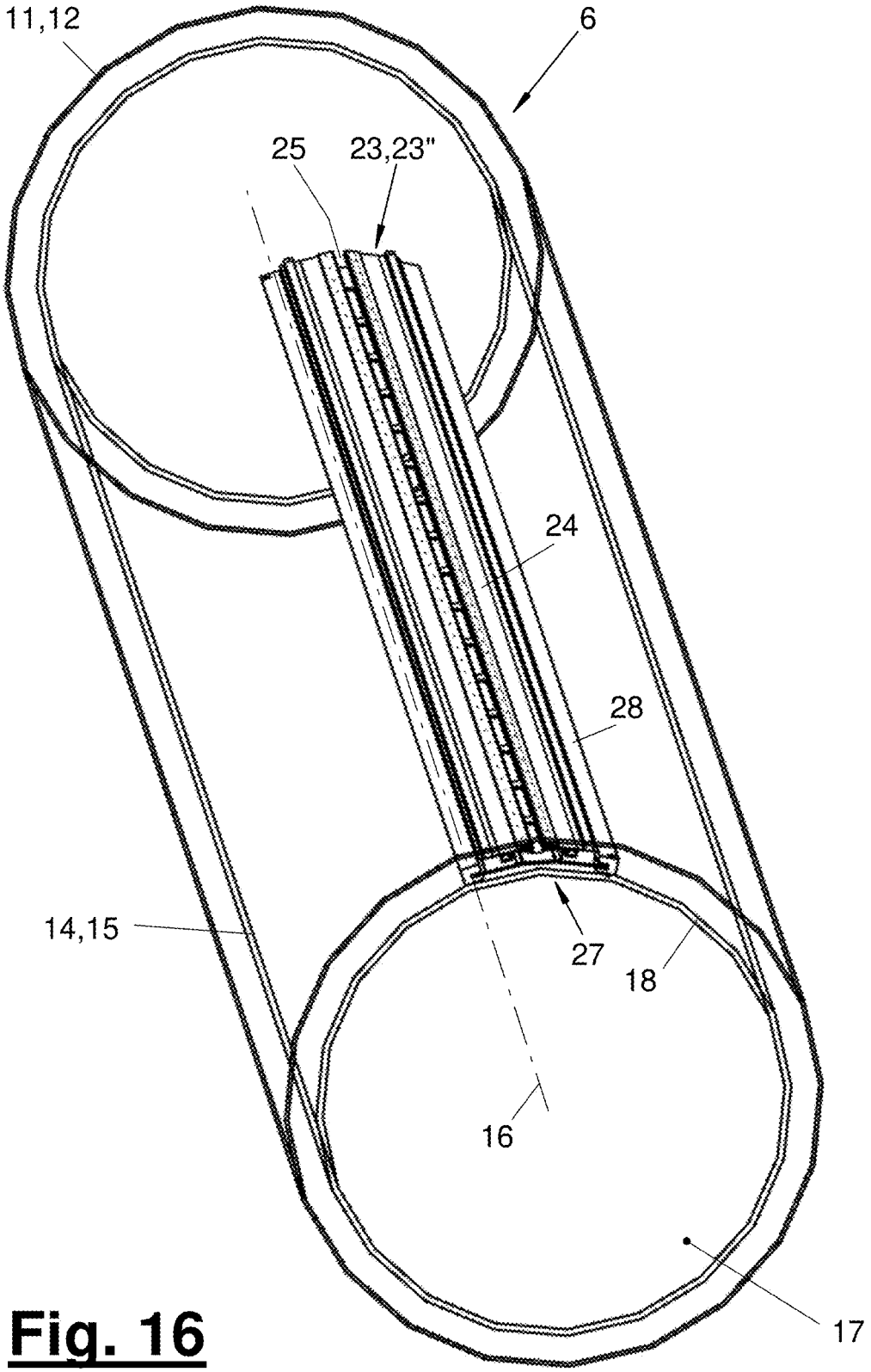

FIGS. 15 and 16 show the suction nozzle (23, 23") in an attached position or installed position at the jet suction box (14). FIGS. 15 and 16 show, in addition, the attached position at a moving conveying device (11), especially a rotating conveying drum (12), of a suction-extraction device (6). The jet suction box (14) and the suction-extraction device (6) may be configured and arranged in the above-described manner. They may also be associated with the above-described hydroentanglement device (1) for liquid jet hydroentanglement, especially water jet hydroentanglement. The further variant of the suction nozzle (23, 23") may be arranged at the jet suction box (14) in the above-described manner.

The further variant of the suction nozzle (23) may further have the above-described opening edge limiter (39). This is not shown in FIGS. 15 and 16 for the sake of clarity. The additional variant of the suction nozzle (23, 23") may have a nozzle body (24). This may have the above-described, closed side walls (38) and closed front walls (38') as well as possibly a grip. The front walls (38') may be arranged at the front ends of the nozzle body (24) in the above-described manner. They are not shown in FIGS. 15 through 20 for the sake of clarity.

Figure 17:
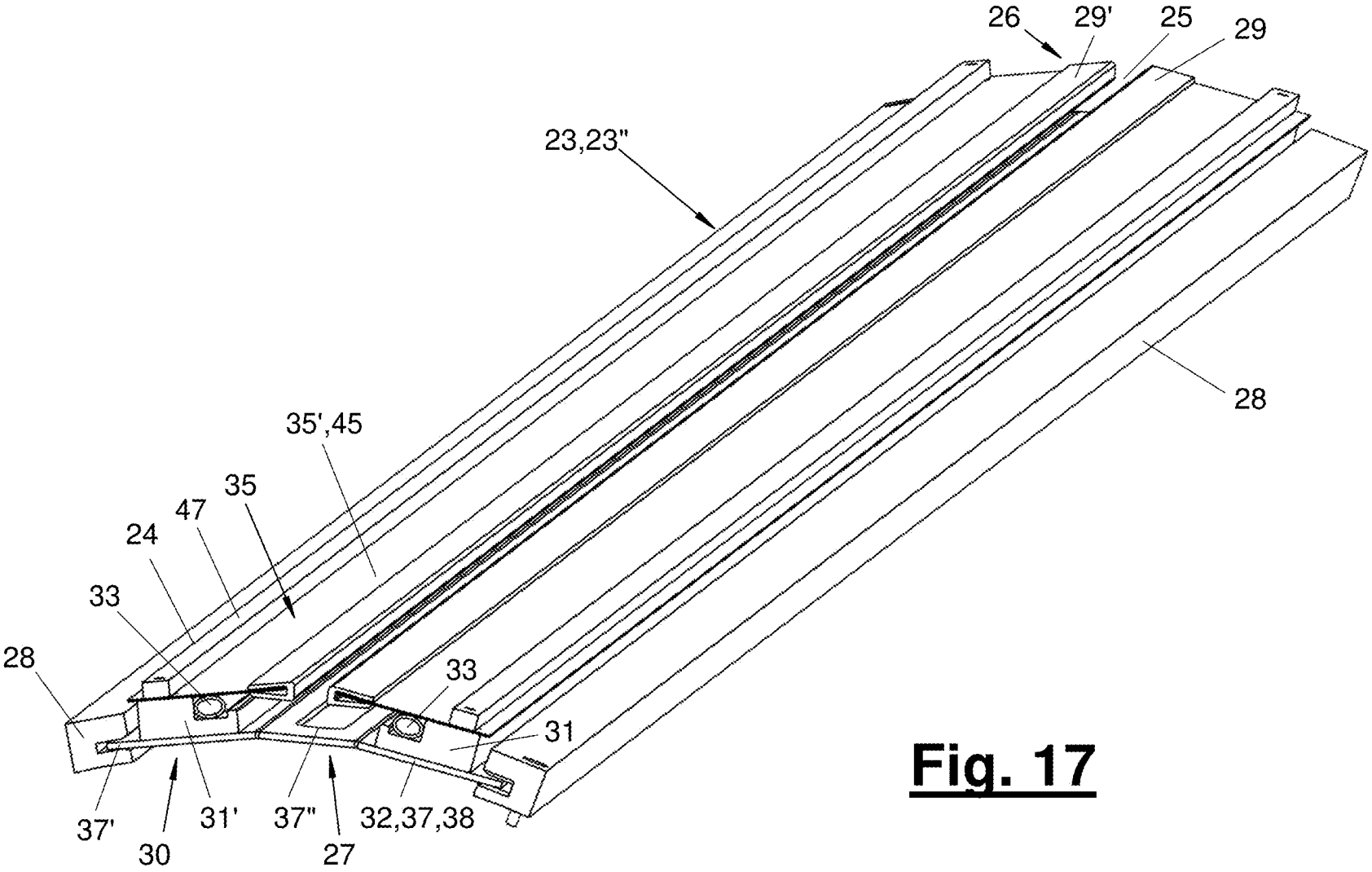
Figure 18:
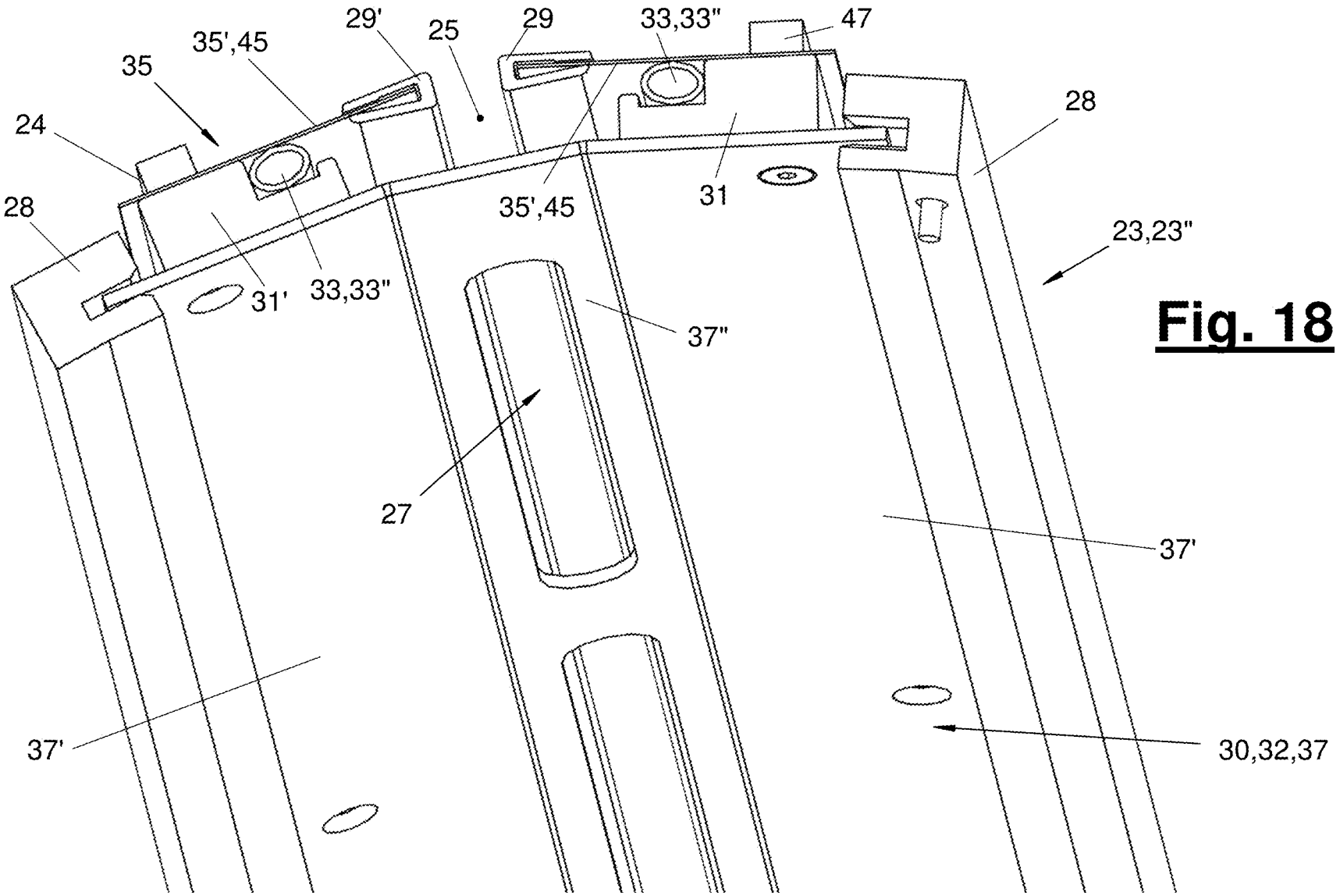
Figure 19:
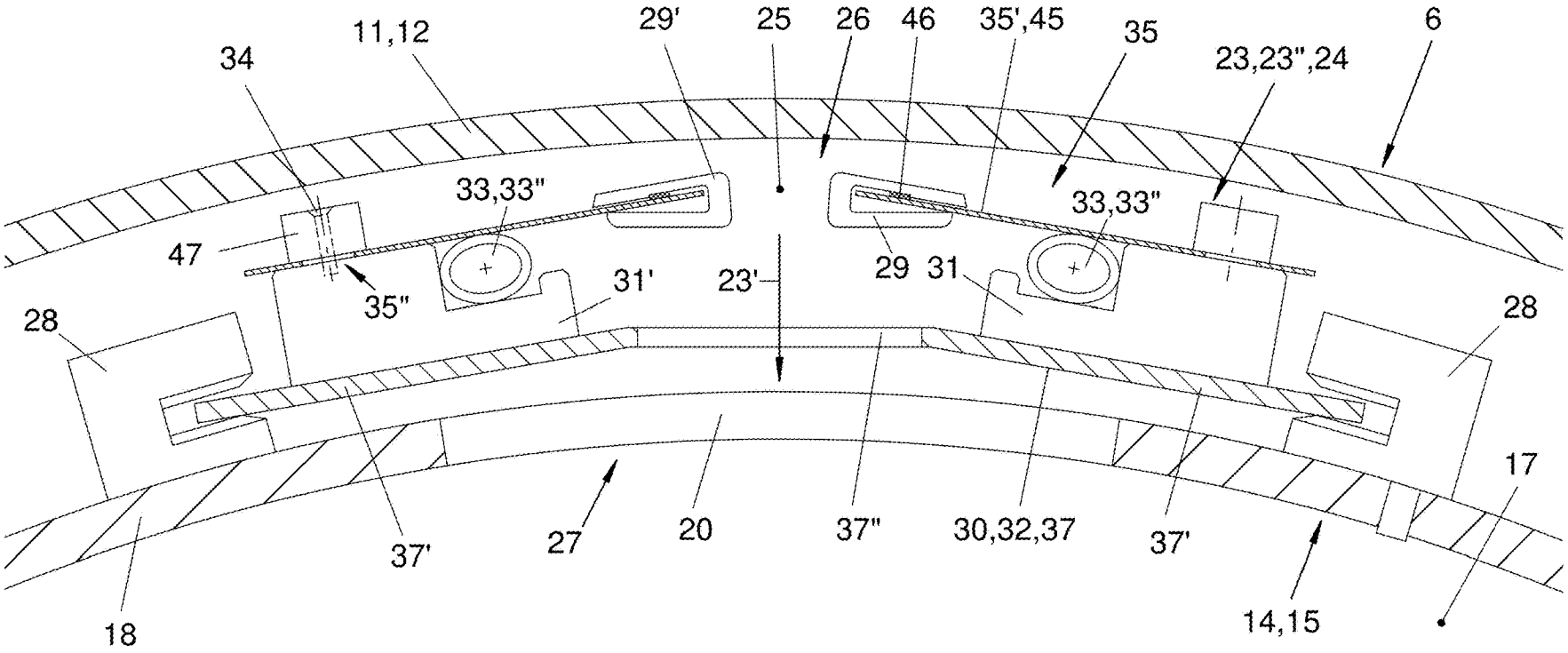
Figure 20:
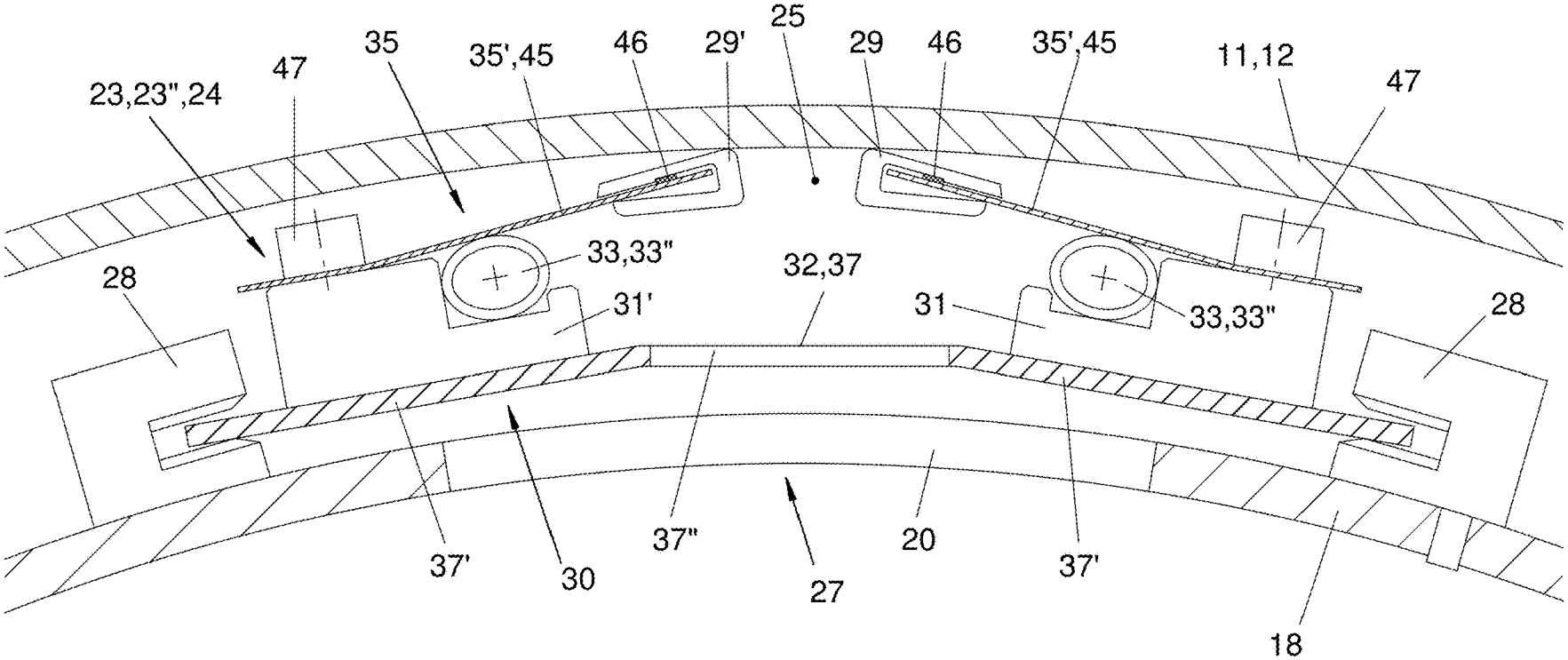

FIGS. 17 and 18 show the suction nozzle (23, 23") in a perspective top view and in a cut-away perspective bottom view. FIGS. 19 and 20 show the suction nozzle (23) in the installed position in a front view and in different operating positions. FIG. 19 shows a released operating position, in which the one or more sealing elements (29, 29') are separated from the conveying device (11), especially the rotating conveying drum (12). The nozzle body (24) can be pulled off in this position axially from the jet suction box (14) in the above-described manner and removed. FIG. 20 shows the operating position in which the one or more sealing elements (29, 29') are sealingly in contact with their outer sides with the facing inner side of the conveying device (11) or with the rotating conveying drum (12).

The nozzle body (24) of the further variant likewise comprises a base part (30), at least one movable sealing element (29, 29') as well as a resilient expansion device (33) acting on the sealing element (29, 29') and a guide device (35). The nozzle body (24) may further have at least one carrying element (31, 31').

The suction nozzle (23, 23") may also comprise a bracket (28), which receives the nozzle body (24), especially the base part (30) thereof, in a movable, especially displaceable manner. The nozzle body (24), which can also be arranged or is arranged above the casing opening (20) in this second variant as well, can be removed from the overlap with the casing opening (20) in at least some areas thanks to the bracket (28). The bracket (28) can be fixed at the box casing (18) in a suitable manner. It may have an arched underside, which is adapted to the outer shape of the box casing and is flatly in contact here. The box casing (18) may have on the outer side a rounded, especially cylindrical shape. It may also have one or more flattened portions (19), just as in the first exemplary embodiments.

The suction nozzle (23, 23") shown in FIGS. 15 through 20 differs from the above-described variants by the configuration and arrangement of the one or more sealing elements (29, 29'), of the one or more resilient expansion devices (33) and of the guide device (35) for the at least one sealing element (29, 29'). The one or more carrying elements (31, 31') may likewise be configured in another manner.

Just as in the first exemplary embodiments, the base part (30) may comprise a support element (32), which comprises, e.g., plate-like webs and can be received at the brackets (28) located on both sides in slots located there in a suitable manner detachably and preferably in a fluid-tight manner. The support element (32) may comprise a support cone (37), which comprises a central cone bottom (37"), through which the suction opening (25) passes, and cone walls (37') adjoining on both sides. The passage openings in the cone bottom (37") are arranged opposite the suction flow direction (23') above the casing opening (20). The suction opening (25) widens, just as in the first exemplary embodiments, in the suction flow direction (23').

The support cone (37) located at a radially spaced location from the box casing (18) is flatter than in the above-described variants. Different space conditions and installation conditions at the jet suction box (14), especially at the jet suction tube (15), and at the associated conveying device (11), especially at the conveying drum (12), can be taken into consideration by varying the cone angle and the other configuration of the base part (30) as well as possibly the at least one carrying element (31, 31').

The one or more mobile sealing elements (29, 29') are arranged at the free end of the nozzle body (24). They are arranged at the inlet side (26) next to the suction opening (25) and they define this laterally. One or more respective sealing elements (29, 29') and one or more resilient expansion devices (33) associated with these are arranged on both sides of the suction opening (25) in the variant shown. Said resilient expansion devices are used to push the sealing element (29, 29') in question away from the outlet side (27) or away from the casing opening (20) against the suction flow direction towards the outside and into contact with the moving conveying device (11). The sealing elements (29, 29') located on both sides have side walls directed towards the suction opening (25) and extending along the suction opening (25) in the direction at right angles to the suction flow direction. The sealing elements (29, 29') located on both sides define between them the suction opening (25) on the inlet side (26).

In the second variant, the one or more sealing elements (29, 29') are arranged and fastened each at a guide unit (35') of the guide device (35), which guide unit is configured as a preferably flat leaf spring (45). The leaf spring (45) guides the respective corresponding sealing element (29, 29') by a pivoting motion in and against the suction flow direction (23'). The leaf spring (45) extends mainly at right angles to the suction flow direction (23').

The leaf spring (45) is clamped on one side at a, for example, outer edge pointing away from the suction opening (25). The clamping may be brought about at a carrying element (31, 31') or directly at the base part (30). This can be effected by means of a clamping part (47), e.g., an axial clamping strip, wherein the clamping part (47) can be fixed, for example, at the carrying element (31, 31'), with screws or in another manner.

The carrying element (31, 31') can be arranged and fixed on the outer side to the base part (30), especially to a cone wall (37'). The carrying element (31, 31') can also receive the resilient expansion device (33). This is arranged between the base part (30) and the one or more mobile sealing elements (29, 29'). The carrying elements (31, 31'), which are located on both sides and are spaced apart from one another laterally, define with their inner side walls the suction opening (25), whose cross section expands in the suction flow direction (23') starting from the sealing elements (29, 29').

The carrying element (31, 31') may have a base-like configuration. It may have a trough-like mount for the resilient expansion device (33) on the top side. This is arranged, e.g., under the leaf spring (45). It acts on the leaf spring (45) from below and deforms this during its expansion. The resilient expansion device (33) acts hereby indirectly on the associated mobile sealing element (29, 29').

At the other edge pointing towards the suction opening (25), the leaf spring (45) carries one or more, preferably strip-like or strip-shaped sealing elements (29, 29'). These are configured, as, e.g., socket strips, which can preferably be mounted and fastened captively at said edge of the leaf spring (45). They are configured, e.g., as clip strips having an essentially U-shaped cross section, whose free web ends are located closely adjacent to one another and are in contact with spring force with the leaf spring edge inserted between them. The cross web of the essentially U-shaped clip strips forms with its bottom the preferably flat side wall of the sealing element (29, 29'), which side wall is directed towards the suction opening (25). The side wall extends at right angles to and also along, preferably in parallel, to the suction flow direction (23').

The one or more sealing elements (29, 29') may be fastened to the leaf spring (45) in any desired and suitable manner. A positive-locking fastening with a fixing device (46) is preferably present. The fixing device (46) may be formed, e.g., by a rabbet on the upper side and/or on the underside of the leaf spring (45) and at a corresponding stop hole at the inner wall of the clip strip. The sealing element (29, 29') can be taken off and removed or replaced hereby with ease. As an alternative, other manners of fastening, e.g., positive-locking fastening by means of screws or bolts and/or non-positive fastening by bonding, etc., are possible.

The guide device (35) comprises said guide unit (35') acting along the suction flow direction (23'). It may also comprise a guide unit (35") acting at right angles to the suction flow direction (23'). The guide unit (35") may be arranged and formed between the leaf spring (45) and the carrying element (31, 31').

As is shown on the left-hand side of FIG. 19 as an example, the guide unit (35") may have one or more elongated holes in the edge area of the leaf spring (45), which cooperate with said screw or with another fastening device of the clamping part (47). Said screw may also be part of an adjusting device (34) here. By removing the screw, the clamping of the leaf spring (45) can be abolished and the leaf spring can be adjusted to change the width of the nozzle opening (25).

The one or more resilient expansion devices (33) are configured in the above-described manner as switchable, controllable or possibly regulatable expanders (33"). FIGS. 19 and 20 show as an example a configuration as an inflatable and stretchable flexible pressure tubing or bellows.

In the inoperative position according to FIG. 19, the at least one expander (33") is released and contracted, and the leaf spring located above it extends normally and is preferably straight and flat. In the operating position according to FIG. 20, the expander (33") is actuated and expanded, and it deforms the leaf spring (45) clamped at the edge by bending and presses thereby the at least one sealing element (29, 29') located at the edge of the leaf spring against the moving conveying device (11).

A preferably compressible pressurized medium, e.g., compressed air, can be admitted into the one or more expanders (33") in the above-described manner in a switchable, controllable and possibly regulatable manner, and said one or more expanders can thus, e.g., be inflated. They are supported now in the mount at the carrying element (31, 31') and expand in the direction of the leaf spring (45), which is in contact. In another embodiment, not shown, the one or more expanders (33") may be configured as extensible cylinders or other expansion bodies, which are operated with said pressurized medium.

The fibrous material web (2) strengthened with the liquid jets (4) in one or more hydroentanglement devices (1) may be transported to a downstream further processing unit, not shown. This may be, e.g., a drying device with a squeezing unit and/or with a drying oven or the like. This may be followed by further processing devices, e.g., a nonwoven-layering apparatus, a winding device, a cutting unit or the like.

Various variants of the embodiments shown and described and of said variants are possible. In particular, the mentioned features of the exemplary embodiments and variants may be combined with one another and possibly also transposed as desired within the framework of the claims. While specific embodiments of the invention have been shown and described in detail to illustrate the application of the principles of the invention, it will be understood that the invention may be embodied otherwise without departing from such principles.

LIST OF REFERENCE NUMBERS

1 Hydroentanglement device
2 Fibrous material web
3 Injector, nozzle bar
4 Liquid jet, water jet
5 Conveying device
6 Suction-extraction device
7 Negative-pressure generator
8 Recovery unit
9 Return, water
10 Outlet, air
11 Conveying device
12 Conveying drum
13 Drive
14 Jet suction box
15 Jet suction tube
16 Axis, box axis

17 Box interior space
18 Box casing
19 Flattened portion
20 Casing opening
21 Strut
22 Intermediate space
23 Suction nozzle
23' Jet suction direction
23" Additional suction nozzle
24 Nozzle body
25 Suction opening
26 Inlet side
27 Outlet side
28 Bracket
29 Sealing element
29' Sealing element
30 Base part
31 Carrying element
31' Carrying element
32 Support element
33 Expansion device
33' Compression spring
33" Expander
34 Adjusting device
34' Adjusting unit
35 Guide device
35' Guide unit, longitudinal
35" Guide unit, transverse
36 Sealing apron
37 Support cone
37' Cone wall
37" Cone bottom
38 Side wall
38' Front wall
39 Opening edge limiter
40 Slide
40' Slide guide
40" Projection
41 Bearing surface
42 Flange
43 Suction opening
44 Grip
45 Leaf spring
46 Fixing device
47 Clamping part, clamping strip

What is claimed is:

1. A suction-extraction device of a hydroentanglement device for a hydroentanglement of a moving fibrous material web with liquid jets, the suction-extraction device comprising:

a jet suction box that is intended and configured to suck the liquid jets, which are emitted by the hydroentanglement device and are discharged again from the fibrous material web, in a suction flow, the jet suction box comprising:

a box casing having at least one slot casing opening leading to a box interior space; and at least one suction nozzle at the box casing, the at least one suction nozzle comprising: a nozzle body arranged above the slot suction opening, with a slot suction opening passing through the nozzle body, the slot suction opening having an inlet side that is directed outwards relative to the box casing and an outlet side directed towards the slot casing opening, wherein the slot suction opening extends along a suction flow direction from the inlet side at a free end of the nozzle body to the outlet side at the at least one the slot suction opening; at least one mobile sealing element on the inlet side of the nozzle body, the at least one mobile sealing element being arranged adjacent to the slot suction opening and laterally defining the slot suction opening; and at least one resilient expansion device acting on the sealing element, the least one resilient expansion device being configured to push the sealing element away from the outlet side against the suction flow direction; and a liquid-permeable conveying device for moving to convey the fibrous material web, wherein the jet suction box is arranged relatively stationarily in relation to the conveying device and wherein the at least one mobile sealing element is sealingly in contact, at an outer side of the at least one mobile sealing element, with the conveying device.

2. A suction-extraction device in accordance with claim 1, wherein the at least one mobile sealing element is intended and configured to be sealingly in contact at an outer side of the at least one mobile sealing element with the liquid-permeable conveying device for the fibrous material web.

3. A suction-extraction device in accordance with claim 1, wherein the at least one suction nozzle further comprises another mobile sealing element to provide two sealing elements and another resilient expansion device to provide two resilient expansion devices, wherein:

the sealing elements and the resilient expansion devices are arranged at the free end of the nozzle body on both sides along the slot suction opening; and the sealing elements arranged on both sides define between them the slot suction opening.

4. A suction-extraction device in accordance with claim 1, wherein the at least one mobile sealing element has a strip configuration and extends relative to a length of the slot suction opening at right angles to the suction flow direction.

5. A suction-extraction device in accordance with claim 1, wherein the at least one resilient expansion device comprises one or more compression springs.

6. A suction-extraction device in accordance with claim 1, wherein:

the at least one mobile sealing element is arranged at the nozzle body and is moveable relative to the suction flow direction; and a width of the slot suction opening is additionally variable.

7. A suction-extraction device in accordance with claim 1, further comprising a bracket, wherein the nozzle body is arrangeable at the box casing by means of the bracket, whereby the nozzle body can be axially moved and can be removed from an overlap with the slot suction opening in at least some areas.

8. A suction-extraction device in accordance with claim 1, wherein:

the nozzle body comprises a guide device for the at least one mobile sealing element;

the guide device is configured to guide the at least one mobile sealing element during motions thereof relative to the suction flow direction, and the guide device comprises a guide unit acting along the suction flow direction.

9. A suction-extraction device in accordance with claim 8, wherein the at least one mobile sealing element has a loose configuration and is independently movable, wherein the guide device comprises a rigid guide unit, which extends along the suction flow direction and guides the at least one mobile sealing element in and against the suction flow direction by a translatory and/or rotatory motion.

10. A suction-extraction device in accordance with claim 8, wherein:

the guide device comprises a deformable guide unit, which extends mainly at right angles to the suction flow direction and guides the sealing element in and against the suction flow direction with a pivoting motion;

the at least one mobile sealing element is mounted at the deformable guide unit; and the at least one resilient expansion device acts on the guide unit and is configured to push the sealing element away from the outlet side, outwards against the suction flow direction.

11. A suction-extraction device in accordance with claim 10, wherein the guide unit, extending relative to the suction flow direction, is configured as a leaf spring clamped at an edge, which leaf spring carries the at least one mobile sealing element at an opposite edge.

12. A suction-extraction device in accordance with claim 1, wherein:

the nozzle body comprises a hollow base part, through which the slot suction opening passes, and on which the at least one mobile sealing element is arranged; and the resilient expansion device is arranged between the hollow base part and the at least one mobile sealing element.

13. A suction-extraction device in accordance with claim 12, wherein:

the hollow base part comprises a support element, which can be arranged above the slot suction opening and at least one carrying element, which is arranged between the support element and the at least one mobile sealing element; and the resilient expansion device is on the at least one carrying element and acts on the sealing element.

14. A suction-extraction device in accordance with claim 1, further comprising:

a negative-pressure generator connected to the jet suction box in a flow-carrying manner; and a recovery unit configured to recover liquid contained in the sucked flow.

15. A suction-extraction device in accordance with claim 1, wherein the jet suction box is arranged under the conveying device for the fibrous material web relative to in an emission direction of the liquid jets.

16. A suction-extraction device in accordance with claim 1, in combination with at least one injector, which emits the liquid jets under pressure to form a hydroentanglement device for a hydroentanglement of a fibrous material web with liquid jets, wherein the at least one injector directs the emitted liquid jets into the at least one suction nozzle of the jet suction box, which at least one suction nozzle is located opposite to the at least one injector relative to an emission direction of the liquid jets.

17. A hydroentanglement device in accordance with claim 16, wherein the suction-extraction device further comprises:

one or more additional injectors to provide a plurality of injectors arranged next to each other in a running direction of the fibrous material web; and one or more additional suction nozzles to provide the jet suction box with a plurality of suction nozzles directed towards the fibrous material web, wherein each of the injectors is positioned opposite an associated one of the plurality of suction nozzles of the jet suction box relative to the emission direction of the liquid jets, and wherein one or more of the plurality of suction nozzles directed towards the fibrous material web do not have an associated injector.

18. A suction-extraction device in accordance with claim 1, wherein the at least one resilient expansion device comprises an expander which is configured to be expanded in a controlled manner.

19. A method for sucking liquid jets which jets are emitted from a hydroentanglement device towards a fibrous material web, which material web is moved by a liquid-permeable conveying device, and which jets leave the fibrous material web, the method comprising the steps of:

sucking the liquid jets being discharged, wherein the sucking is by means of a hollow jet suction box of a suction-extraction device in a suction flow;

providing the jet suction box, wherein the hollow jet suction box comprises a box casing with at least one slot casing opening leading to a box casing interior space of the box casing;

providing at least one suction nozzle at the box casing, the at least one suction nozzle comprising: a nozzle body arranged above the at least one slot casing opening, with a slot suction opening passing through the nozzle body, the slot suction opening having an inlet side that is directed outwards relative to the box casing and an outlet side directed towards the at least one slot casing opening, wherein the slot suction opening extends along a suction flow direction from the inlet side at a free end of the nozzle body to the outlet side directed towards the at least one slot casing opening; at least one mobile sealing element on the inlet side of the nozzle body, the at least one mobile sealing element being arranged adjacent to the slot suction opening and laterally defining the slot suction opening; and at least one resilient expansion device acting on the sealing element, the least one resilient expansion device being configured to push the sealing element away from the outlet side against the suction flow direction.

* * * * *